US012434869B2

(12) United States Patent
Nagashima et al.

(10) Patent No.: US 12,434,869 B2
(45) Date of Patent: Oct. 7, 2025

(54) BAGMAKING AND PACKAGING APPARATUS AND WEIGHING AND PACKAGING SYSTEM

(71) Applicant: ISHIDA CO., LTD., Kyoto (JP)

(72) Inventors: Ryota Nagashima, Ritto (JP); Toshiharu Kageyama, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 0 days.

(21) Appl. No.: 18/396,699

(22) Filed: Dec. 27, 2023

(65) Prior Publication Data

US 2024/0228081 A1 Jul. 11, 2024

(30) Foreign Application Priority Data

Jan. 11, 2023 (JP) ..... 2023-002168

(51) Int. Cl.
*B65B 1/32* (2006.01)
*B65B 9/08* (2012.01)
*B65B 39/00* (2006.01)

(52) U.S. Cl.
CPC ..... *B65B 1/32* (2013.01); *B65B 9/08* (2013.01); *B65B 39/001* (2013.01)

(58) Field of Classification Search
CPC ..... B65B 39/001; B65B 9/08; B65B 1/32
See application file for complete search history.

(56) References Cited

U.S. PATENT DOCUMENTS 11,066,196 B2 * 7/2021 Kageyama ..... B65B 59/04
2005/0066629 A1 * 3/2005 Taylor ..... B65B 9/22 53/551

(Continued)

FOREIGN PATENT DOCUMENTS

CN 108454899 A 8/2018
CN 109677656 A 4/2019

(Continued)

OTHER PUBLICATIONS

Lineequipment: "LE360 Twin Bagging Machine—UK Built," Feb. 4, 2021 (Feb. 4, 2021), XP093180290 Retrieved from Internet. URL:https://www.youtube.com/watch?V=7Hp7mXempFA&list=PLVPxAkNiruYIhJzRnkRsoCQyZNzkWbcmk&ab_channel=LineEquipment (Retreived on Jul. 1, 2024).

(Continued)

*Primary Examiner* — Andrew M Tecco
*Assistant Examiner* — Nicholas E Igbokwe
(74) *Attorney, Agent, or Firm* — United IP Counselors, LLC

(57) ABSTRACT

Two bagmaking and packaging machines are installed side-by-side. Each of the bagmaking and packaging machines includes a film supply unit in the rear portion, a former mechanism in the front portion, and a transverse sealing mechanism that transversely seals a top and a bottom of the film in the tubular shape into which a product supplied from a combination weighing apparatus is fed. Each of the bagmaking and packaging machines is disposed under a discharge chute of a corresponding combination weighing machine, which includes two combination weighing machines joined to each other substantially symmetrically in the left and right direction as viewed from above and a base member that supports the combination weighing machines. A maximum width of the bagmaking and packaging apparatus when viewed from the front is narrower than a width of the base member.

10 Claims, 13 Drawing Sheets

(56) References Cited

U.S. PATENT DOCUMENTS

| | | | | |
|---|---|---|---|---|
| 2012/0210681 | A1* | 8/2012 | Hennissen | B65B 65/006 53/559 |
| 2018/0029734 | A1* | 2/2018 | Kishikawa | B65B 59/04 |
| 2021/0155356 | A1* | 5/2021 | Boccolari | B65B 55/08 |
| 2022/0106069 | A1 | 4/2022 | Dersch | |

FOREIGN PATENT DOCUMENTS

| | | | |
|---|---|---|---|
| CN | 113443242 | A | 9/2021 |
| EP | 2483161 | B1 | 10/2013 |
| JP | 2009-258040 | A | 11/2009 |
| WO | 2014124383 | A1 | 8/2014 |

OTHER PUBLICATIONS

Extended European Search report issued in counterpart European Application No. 23219134.6, dated Jul. 22, 2024.

* cited by examiner

BAGMAKING AND PACKAGING APPARATUS AND WEIGHING AND PACKAGING SYSTEM

CROSS-REFERENCE TO RELATED APPLICATIONS

This application is based on and claims the priority benefit of JP 2023-002168 filed Jan. 11, 2023, the contents of which are incorporated by reference.

BACKGROUND

Technical Field

The claimed invention relates to a bagmaking and packaging apparatus and a weighing and packaging system that includes a combination weighing apparatus and the bagmaking and packaging apparatus.

Related Art

Combination weighing apparatus such as disclosed in JP-A No. 2009-258040 are known which have two combination weighing machines joined to each other symmetrically in a left and right direction and which use a base member to integrally support the two combination weighing machines.

Utilizing such combination weighing apparatus can reduce the width of the space needed to install the combination weighing apparatus compared with simply arranging two combination weighing machines (combination weighing apparatus comprising a single combination weighing machine) side by side.

In this connection, combination weighing apparatus such as disclosed in JP-A No. 2009-258040 are frequently used in combination with two bagmaking and packaging machines disposed under the combination weighing apparatus.

In a system comprising such a combination, although the width of the space needed to install the combination weighing apparatus is reduced, the width needed to install the system is not sufficiently reduced due to problems on the part of the bagmaking and packaging machines disposed under the combination weighing apparatus.

SUMMARY

A bagmaking and packaging apparatus pertaining to a first aspect of the claimed invention comprises two bagmaking and packaging machines installed side by side in a left and right direction. Each of the bagmaking and packaging machines includes a film supply unit, a former mechanism, a transverse sealing mechanism, and a control unit. The film supply unit is disposed in a rear portion of the bagmaking and packaging machine. The former mechanism is disposed in a front portion of the bagmaking and packaging machine. The former mechanism has a former and a tube. The former mechanism is configured to form in a tubular shape a sheet-form film supplied from the film supply unit in the rear portion of the bagmaking and packaging machine. The transverse sealing mechanism is disposed below the former mechanism. The transverse sealing mechanism is configured to transversely seal a top and a bottom of the film in the tubular shape into which a product supplied from above is fed. The control unit is configured to control the operations of the film supply unit and the transverse scaling mechanism. Each of the bagmaking and packaging machines is disposed under a discharge chute of a corresponding one of combination weighing machines of a combination weighing apparatus. The combination weighing apparatus includes two combination weighing machines joined to each other substantially symmetrically in the left and right direction as viewed in a top view and a base member that integrally supports the combination weighing machines. Each of the combination weighing machines is configured to supply the product to insides of a plurality of hoppers arranged along part of a circle and is configured to combine and discharge the product being retained inside one or more of the hoppers selected in accordance with a target weight. A maximum width of the bagmaking and packaging apparatus when viewed from the front is narrower than a width of the base member.

In the bagmaking and packaging apparatus of the first aspect, the width of the space required to install a system comprising the bagmaking and packaging apparatus and the combination weighing apparatus can be reduced.

A bagmaking and packaging apparatus pertaining to a second aspect of the claimed invention is the bagmaking and packaging apparatus of the first aspect, wherein each of the bagmaking and packaging machines further includes a housing unit that houses a circuit board of the control unit. The housing unit is disposed rearward of the former mechanism and the transverse sealing mechanism.

In the bagmaking and packaging apparatus of the second aspect, the circuit board of the control unit is disposed not on the left and right sides of the bagmaking and packaging machines but rearward of the former mechanism and the transverse sealing mechanism. Thus, an increase in the left and right width of the space needed to install the bagmaking and packaging apparatus can be reduced.

A bagmaking and packaging apparatus pertaining to a third aspect of the claimed invention is the bagmaking and packaging apparatus of the second aspect, wherein the housing unit is disposed under a conveyance path of the film in the film supply unit.

In the bagmaking and packaging apparatus of the third aspect, because the housing unit that houses the circuit board is disposed under the film supply unit, space can be effectively utilized to realize the compact bagmaking and packaging apparatus. Furthermore, in the bagmaking and packaging apparatus of the third aspect, the front and rear direction width of the space required to install a system comprising the bagmaking and packaging apparatus and the combination weighing apparatus can also be reduced compared with disposing the housing unit rearward of the film supply unit.

A bagmaking and packaging apparatus of a fourth aspect is the bagmaking and packaging apparatus of any of the first aspect to the third aspect, wherein each of the bagmaking and packaging machines includes a plurality of upright support posts. The multiple support posts configure a frame that surrounds at least part of each of the film supply unit, the former mechanism, and the transverse sealing mechanism. A distance between a right end of the support posts disposed rightmost and a left end of the support posts disposed leftmost in the bagmaking and packaging apparatus is smaller than the maximum width of the bagmaking and packaging apparatus.

In the bagmaking and packaging apparatus of the fourth aspect, the distance between the right end of the support posts disposed rightmost and the left end of the support posts disposed leftmost, which particularly affects the left and right width of the space needed to install the bagmaking and packaging apparatus, is smaller than the maximum width of the bagmaking and packaging apparatus. For that reason, in the bagmaking and packaging apparatus of the fourth aspect, it is easy for the width of the space required to install a system comprising the bagmaking and packaging apparatus and the combination weighing apparatus to be reduced.

A bagmaking and packaging apparatus of a fifth aspect is the bagmaking and packaging apparatus of any of the first aspect to the fourth aspect, wherein each of the bagmaking and packaging machines includes a plurality of upright support posts. The multiple support posts configure a frame that surrounds at least part of each of the film supply unit, the former mechanism, and the transverse sealing mechanism. In the bagmaking and packaging machine on a left side, the support post that is foremost on the left side is disposed rearward of the tube of the former mechanism. In the bagmaking and packaging machine on a right side, the support post that is foremost on the right side is disposed rearward of the tube of the former mechanism.

In the bagmaking and packaging apparatus of the fifth aspect, space in which a worker can access devices such as the former mechanisms inside the bagmaking and packaging machines during maintenance such as cleaning is ensured on the left front side of the bagmaking and packaging machine on the left side and on the right front side of the bagmaking and packaging machine on the right side. As a result, in the bagmaking and packaging apparatus of the fifth aspect, the width of the space required to install the bagmaking and packaging apparatus can be reduced while realizing the high maintainability.

A bagmaking and packaging apparatus of a sixth aspect is the bagmaking and packaging apparatus of any of the first aspect to the fifth aspect, wherein the two bagmaking and packaging machines have a substantially line-symmetrical structure in the left and right direction. Each of the bagmaking and packaging machines has an opening in at least part of its side surface that opposes the other bagmaking and packaging machine.

When the two bagmaking and packaging machines are installed close to each other in the left and right direction, it is difficult to access each of the bagmaking and packaging machines from the sides on which the bagmaking and packaging machines are adjacent to each other. For that reason, space in which cleaning and such are difficult tends to arise on the side of each of the bagmaking and packaging machines on which the two bagmaking and packaging machines are in close proximity to each other.

However, in the bagmaking and packaging apparatus of the sixth aspect, because the openings are formed in mutually opposing surfaces, a space that is continuous from the right end to the left end of the bagmaking and packaging apparatus is formed in the bagmaking and packaging apparatus. By configuring the bagmaking and packaging apparatus in this way, dirt that has accumulated on the side of each of the bagmaking and packaging machines on which the two bagmaking and packaging machines are in close proximity to each other can be easily moved to the left side/right side of the bagmaking and packaging machine disposed on the left side/right side by, for example, blowing air in from the right side/left side of the bagmaking and packaging machine disposed on the right side/left side. As a result, in the bagmaking and packaging apparatus of the sixth aspect, the width of the installation space can be reduced while realizing the high cleanability.

A bagmaking and packaging apparatus of a seventh aspect is the bagmaking and packaging apparatus of the sixth aspect, further including a gap-closing member that is provided between the two bagmaking and packaging machines and closes off a gap between the bagmaking and packaging machines.

In the bagmaking and packaging apparatus of the seventh aspect, debris can be prevented from falling through the gap between the bagmaking and packaging machines. Thus, the bagmaking and packaging apparatus is hygienic.

A bagmaking and packaging apparatus of an eighth aspect is the bagmaking and packaging apparatus of any of the first aspect to the seventh aspect, wherein each of the bagmaking and packaging machines has a partition plate that is disposed between the former mechanism and the transverse sealing mechanism in an up and down direction.

In the bagmaking and packaging apparatus of the eighth aspect, the partition plates are disposed between the former mechanisms and the transverse sealing mechanisms. Thus, the transverse sealing mechanisms are less likely to be dirtied by debris such as fragments of the product dropped and supplied by the combination weighing apparatus. Furthermore, in the bagmaking and packaging apparatus of the eighth aspect, the partition plates disposed between the former mechanisms and the transverse sealing mechanisms are plate-shaped, so when fragments and such of the product dropped and supplied by the combination weighing apparatus fall onto the partition plates, it is easy to remove them.

For that reason, in the bagmaking and packaging apparatus of the eighth aspect, it is easy to keep the bagmaking and packaging apparatus clean even when there is less space that can be utilized for maintenance due to the two bagmaking and packaging machines being disposed in close proximity to each other in the left and right direction.

A weighing and packaging system of a ninth aspect includes the bagmaking and packaging apparatus of any of the first aspect to the eighth aspect and the combination weighing apparatus. The combination weighing apparatus includes the two combination weighing machines that are joined to each other substantially symmetrically in the left and right direction and the base member that integrally supports the combination weighing machines. Each of the combination weighing machines has the multiple hoppers disposed along part of a circle as viewed in a top view and the discharge chute, is configured to weigh the product supplied to the insides of the hoppers, combine the product being retained inside one or more of the hoppers selected in accordance with the target weight, and discharge the product from the discharge chute.

In the weighing and packaging system of the ninth aspect, the width of the space required to install the system comprising the bagmaking and packaging apparatus and the combination weighing apparatus can be reduced.

A weighing and packaging system of a tenth aspect is the weighing and packaging system of the ninth aspect, further including an elevated platform. The elevated platform has a walk board disposed around the base member and an elevated platform frame that supports the walk board.

In the weighing and packaging system of the tenth aspect, maintenance space can be ensured around the combination weighing apparatus.

With the bagmaking and packaging apparatus and the weighing and packaging system of the claimed invention, the width of the space required to install a system comprising a bagmaking and packaging apparatus and a combination weighing apparatus can be reduced.

DETAILED DESCRIPTION

A weighing and packaging system 1, which is an embodiment of the weighing and packaging system of the claimed invention, and a bagmaking and packaging apparatus 10, which is an embodiment of the bagmaking and packaging apparatus of the claimed invention, will be described with reference to the drawings. It will be noted that the following embodiment is a specific example of the claimed invention and is not intended to limit the technical scope of the claimed invention.

In the following description, expressions such as perpendicular, orthogonal, horizontal, vertical, and symmetrical are sometimes used to describe directions and positional relationships, but these expressions are not limited to their strict senses and include cases where that which they describe are substantially perpendicular, orthogonal, horizontal, vertical, or symmetrical to the extent that obtained structures, advantageous effects, and functions substantially do not change. Furthermore, in the following description, expressions such as "substantially" and "about" are sometimes used, and although these expressions clearly indicate that the words to which the expressions are added are not limited to their strict senses, words not used together with these expressions are also not limited to their strict senses. Furthermore, in the following description, expressions such as front (front elevation), rear (rear elevation), above, under, left, and right are used to indicate directions and arrangements. Unless otherwise specified, front (in front of), rear (rear elevation), above, under, left, and right here follow the directions of the arrows added to the drawings.

It will be noted that in the present disclosure, the side on which film supply units 300 of a bagmaking and packaging apparatus 10 described later are disposed as viewed from the position of bagmaking and packaging units 200 of the bagmaking and packaging apparatus 10 described later will be defined as the rear. Furthermore, a direction that is a horizontal direction and orthogonal to a front and rear direction will be defined as a left and right direction.

(1) Weighing and Packaging System

Figure 1:
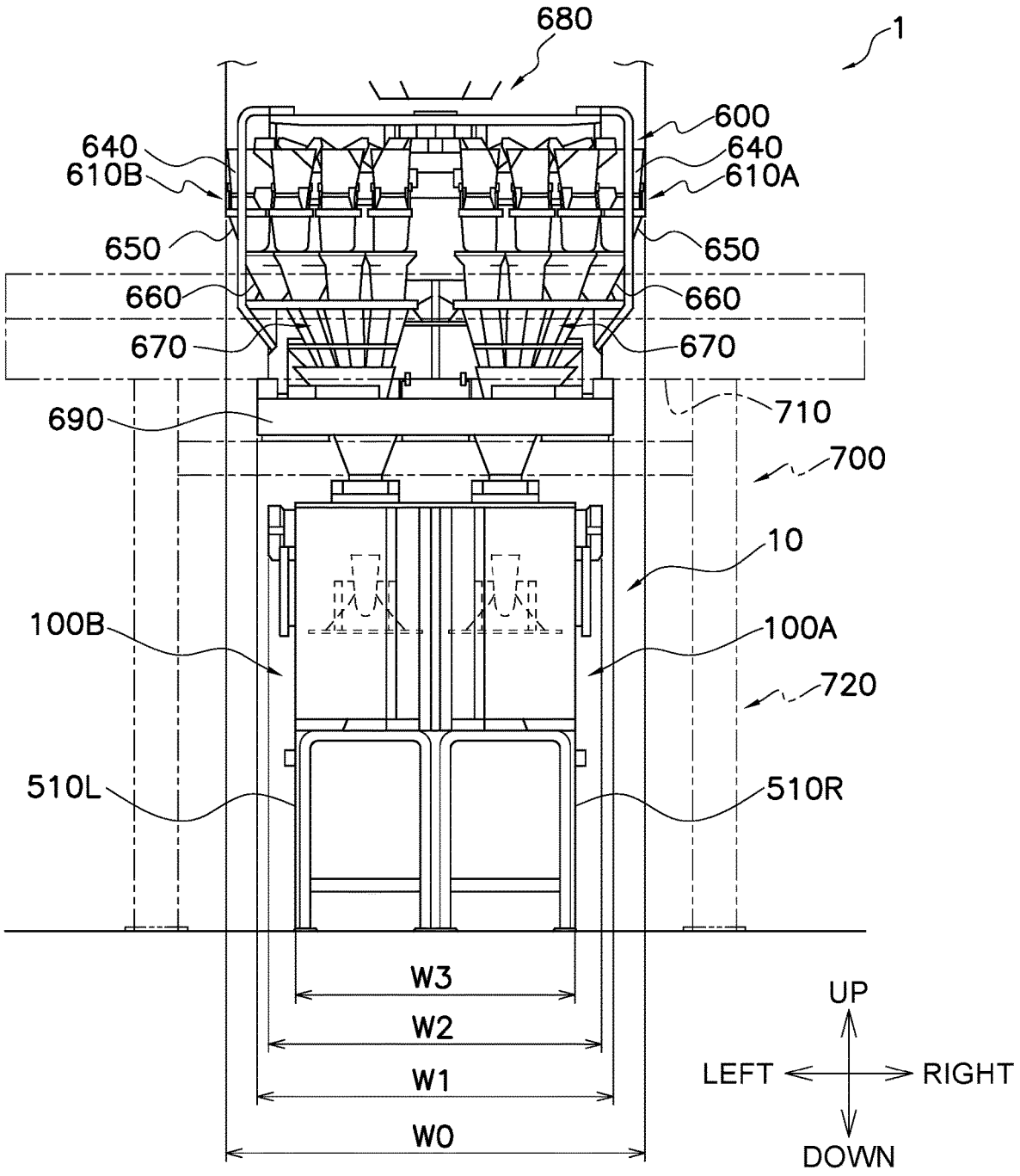
FIG. 1 is a schematic front view of a weighing and packaging system of an embodiment of the claimed invention.

The weighing and packaging system 1 will now be described with reference to FIG. 1. FIG. 1 is a schematic front view of the weighing and packaging system 1.

As shown in FIG. 1, the weighing and packaging system 1 mainly includes a combination weighing apparatus 600, the bagmaking and packaging apparatus 10, and an elevated platform 700.

As shown in FIG. 1, the combination weighing apparatus 600 includes two combination weighing machines 610A, 610B, which are joined to each other symmetrically in the left and right direction, and a base member 690. The base member 690 integrally supports the two combination weighing machines 610A, 610B. In the present embodiment, the combination weighing machine disposed on the right side will be called the combination weighing machine 610A, and the combination weighing machine disposed on the left side will be called the combination weighing machine 610B. Each of the combination weighing machines 610A, 610B uses multiple weigh hoppers 650 described later to weigh a product P supplied to the combination weighing machines 610A, 610B and combines weigh values of the multiple weigh hoppers 650 so that the total weight is within a predetermined weight range (target weight). Then, each of the combination weighing machines 610A, 610B combines the product P being retained inside one or more of the weigh hoppers 650 whose weigh values were selected in accordance with the target weight and eventually discharges the product P from a discharge chute 670 described later.

As shown in FIG. 1, the bagmaking and packaging apparatus 10 includes two bagmaking and packaging machines 100A, 100B installed side by side in the left and right direction. The bagmaking and packaging machine 100A is disposed on the right side, and the bagmaking and packaging machine 100B is disposed on the left side. The bagmaking and packaging machine 100A is disposed under the corresponding combination weighing machine 610A of the combination weighing apparatus 600, and the bagmaking and packaging machine 100B is disposed under the corresponding combination weighing machine 610B of the combination weighing apparatus 600. Each of the bagmaking and packaging machines 100A, 100B receives a supply of the product P from the corresponding combination weighing machine 610A, 610B disposed above it.

Each of the bagmaking and packaging machines 100A, 100B makes a bag-type packaging material from a sheet-form film F to make bags B containing inside the product P supplied from the corresponding combination weighing machine 610A, 610B.

The elevated platform 700 is disposed so as to surround the combination weighing apparatus 600 and the bagmaking and packaging apparatus 10. The elevated platform 700 is a structure that provides maintenance space for the combination weighing apparatus 600. As shown in FIG. 1, the elevated platform 700 has a walk board 710 disposed around the base member 690 of the combination weighing apparatus 600 and an elevated platform frame 720 that supports the walk board 710. A worker stands on the walk board 710 and performs various types of maintenance on the combination weighing apparatus 600.

(2) Combination Weighing Apparatus

Figure 2:
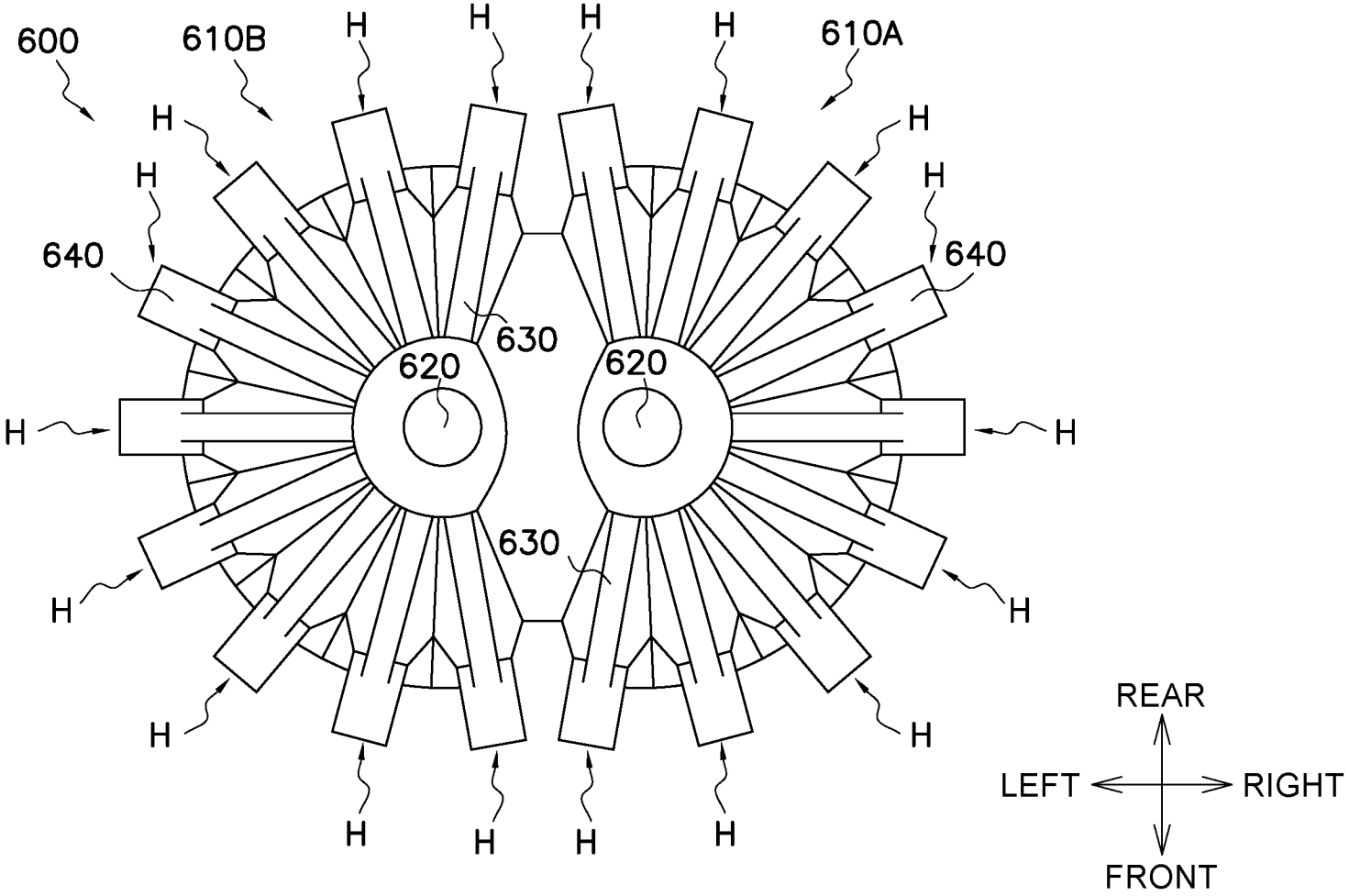
FIG. 2 is a schematic top view of a combination weighing apparatus of FIG. 1.

The combination weighing apparatus 600 will now be described in detail with further reference to FIG. 2. FIG. 2 is a view of the schematic configuration of the combination weighing apparatus 600.

As shown in FIG. 1, the combination weighing apparatus 600 mainly has the two combination weighing machines 610A, 610B, the base member 690, a product sorting unit 680, and a control unit (not shown in the drawings).

The two combination weighing machines 610A, 610B are joined to each other substantially symmetrically in the left and right direction as viewed in a top view (see FIG. 2). In other words, in the combination weighing apparatus 600, the combination weighing machine 610A and the combination weighing machine 610B are joined to each other in a state in which a later-described dispersion table 620 of the combination weighing machine 610A and heads H arranged around the dispersion table 620 are arranged to be substantially bilaterally symmetrical to a dispersion table 620 of the combination weighing machine 610B and heads H arranged around the dispersion table 620 as viewed in a top view.

The base member 690 is a member that supports the combination weighing machine 610A and the combination weighing machine 610B on the lower side. When viewed in the front and rear direction, a width W1 of the base member 690 is narrower than a width W0 of the entire combination weighing apparatus 600.

The product sorting unit 680 sorts and supplies, to the two combination weighing machines 610A, 610B, the product P conveyed thereto by a conveyor (not shown in the drawings). The control unit (not shown in the drawings) of the combination weighing apparatus 600 performs a later-described combinational operation and controls the operations of various configurations for the combination weighing machine 610A and the combination weighing machine 610B.

Each of the combination weighing machines 610A, 610B mainly has a dispersion table 620, multiple heads H arranged around the dispersion table 620, and a discharge chute 670 (see FIG. 2).

Each of the heads H has one each of a radial trough 630, a pool hopper 640, a weigh hopper 650, and a booster hopper 660.

The control unit performs a combinational operation based on the weights of the product P inside the various weigh hoppers 650. The combinational operation is an operation of combining weight values of the product P inside the weigh hoppers 650 and selecting a combination of weight values (a combination of one or more of the weigh hoppers 650 corresponding to the weight values) whose total weight is within a predetermined weight range (target weight). The control unit causes the product P to be discharged from the one or more weigh hoppers 650 selected in accordance with the target weight by the combinational operation or the booster hoppers 660 temporarily retaining the product P weighed by the weigh hoppers 650. The product P discharged from the weigh hoppers 650 or via the booster hoppers 660 is collected inside the discharge chute 670 and discharged from the discharge chute 670 to the bagmaking and packaging machine 100A disposed under the discharge chute 670 and corresponding to the combination weighing machine 610A (or to the bagmaking and packaging machine 100B when the combination weighing machine 610B).

(3) Bagmaking and Packaging Apparatus

Figure 3:
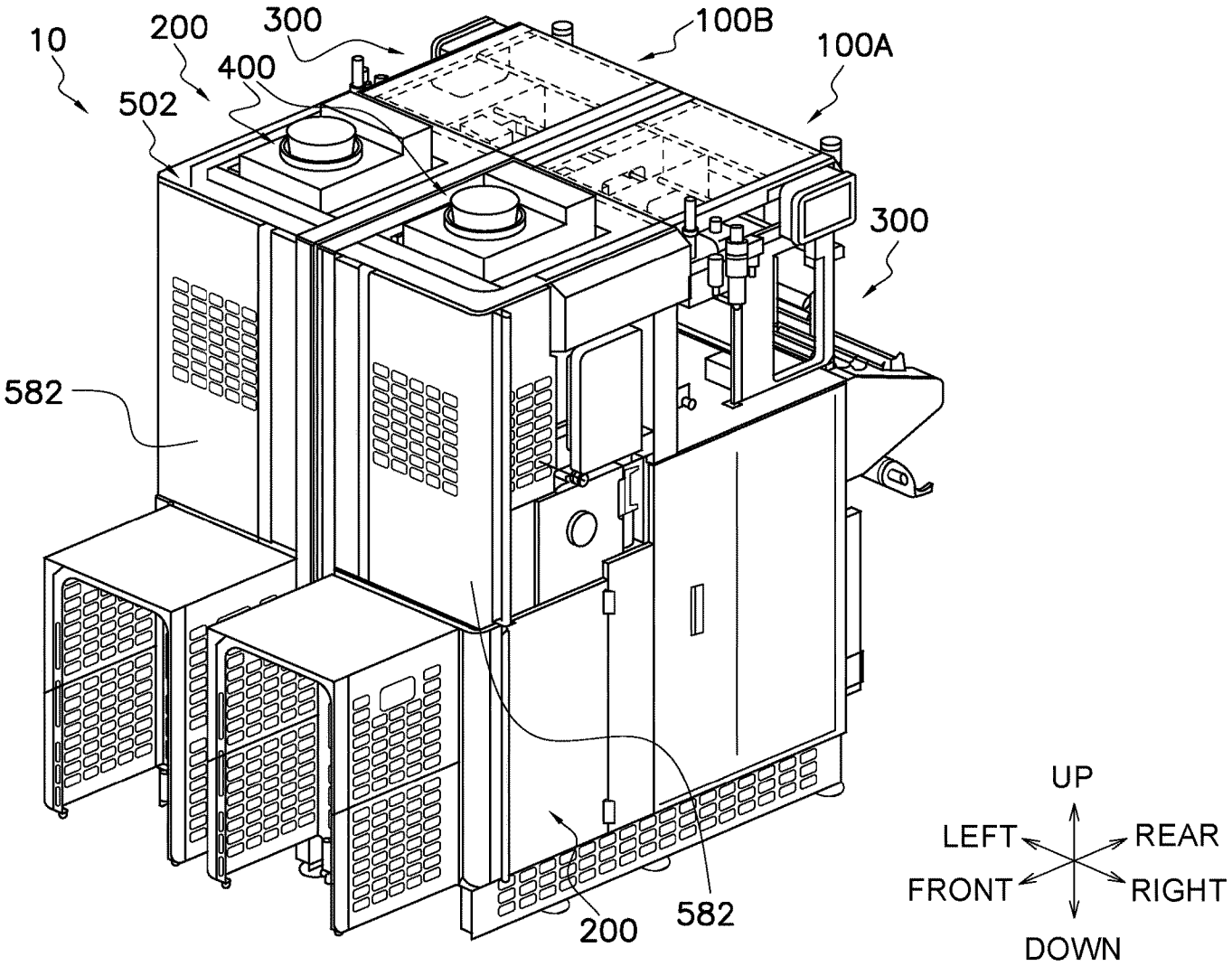
FIG. 3 is a perspective view of the bagmaking and packaging apparatus of the weighing and packaging system of FIG. 1.
Figure 4:
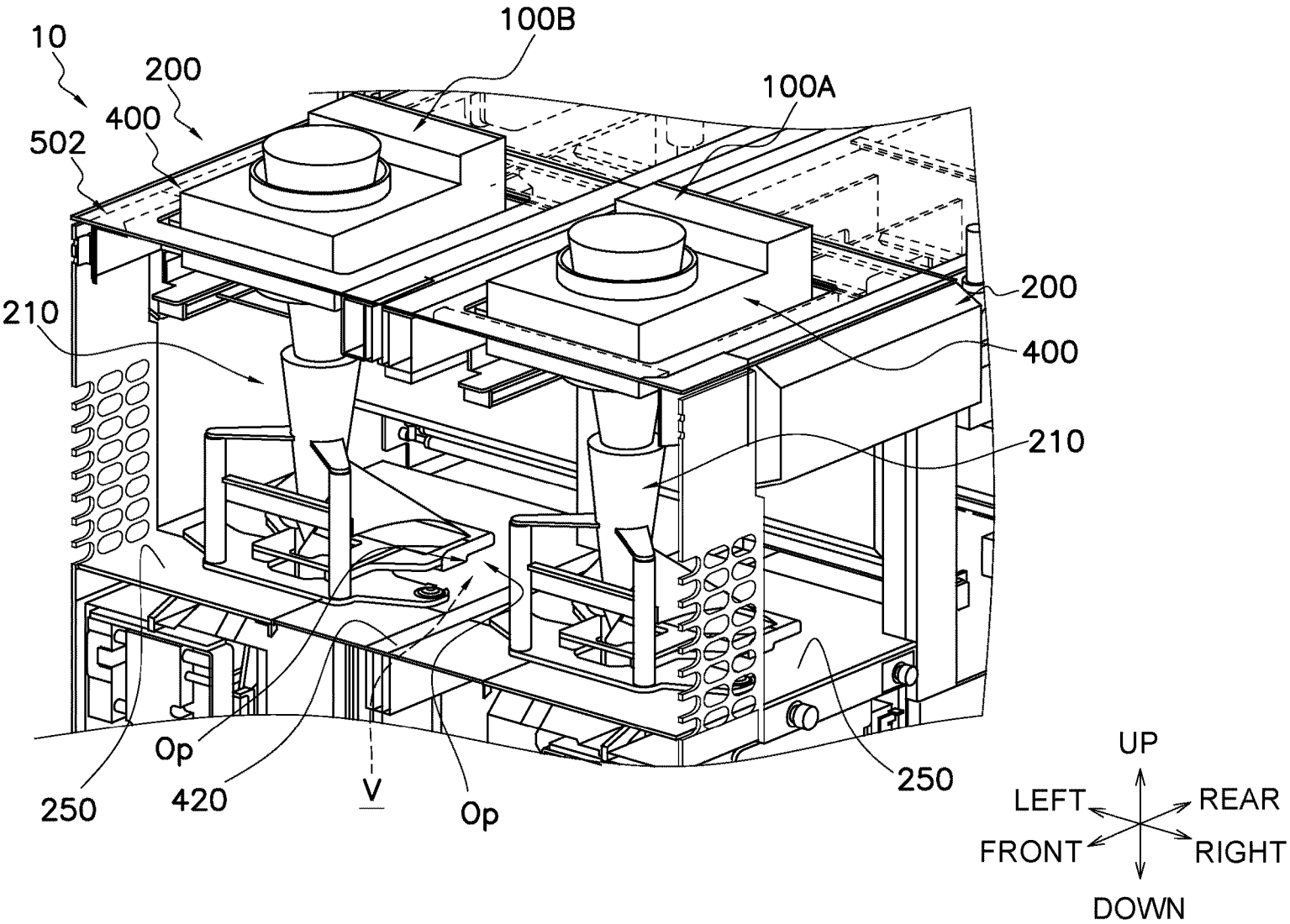
FIG. 4 is a view illustrating the insides of covers of bagmaking and packaging machines of the bagmaking and packaging apparatus of FIG. 3.
Figure 5:
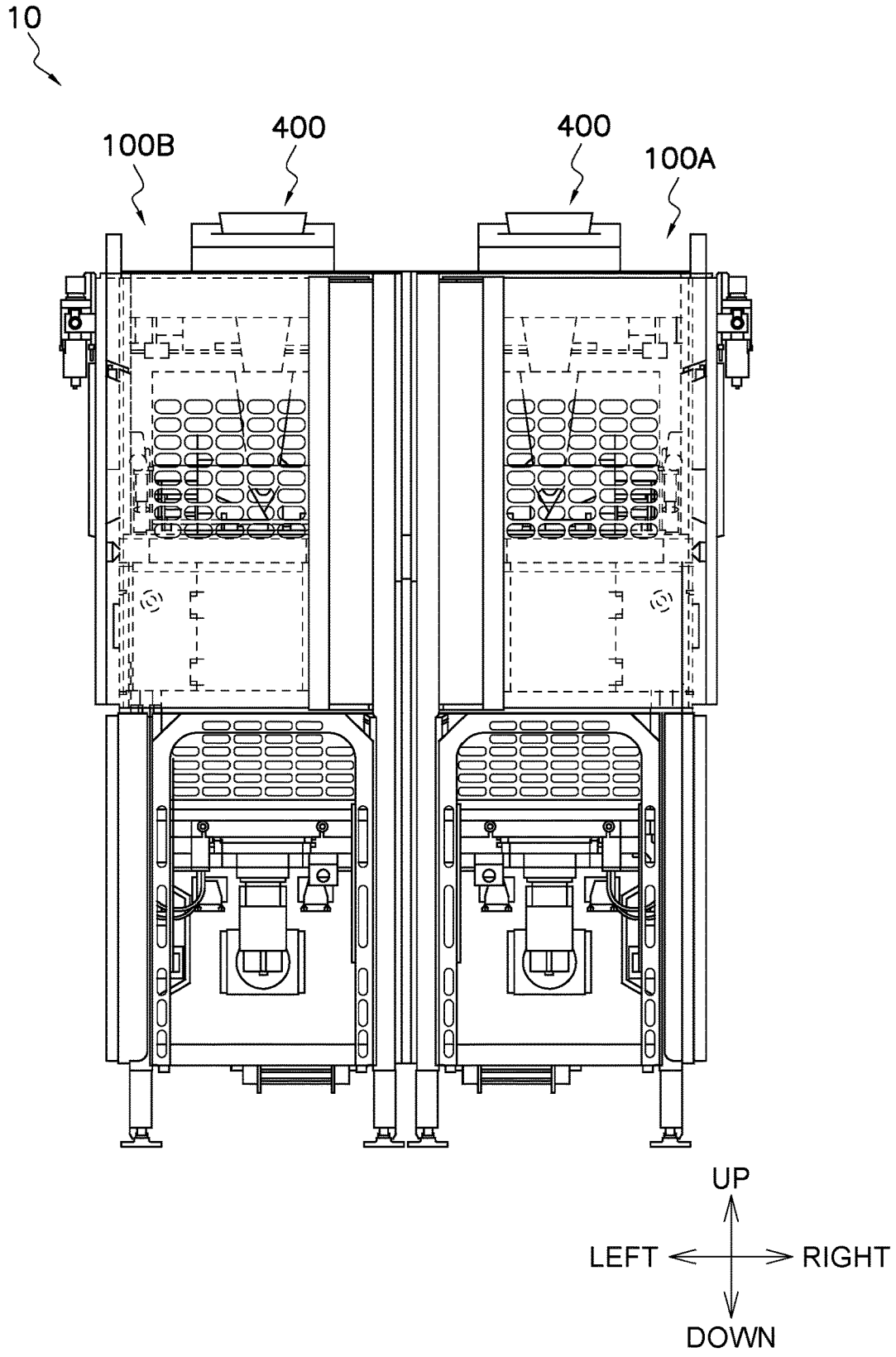
FIG. 5 is a schematic front elevation view of the bagmaking and packaging apparatus of FIG. 3.
Figure 6:
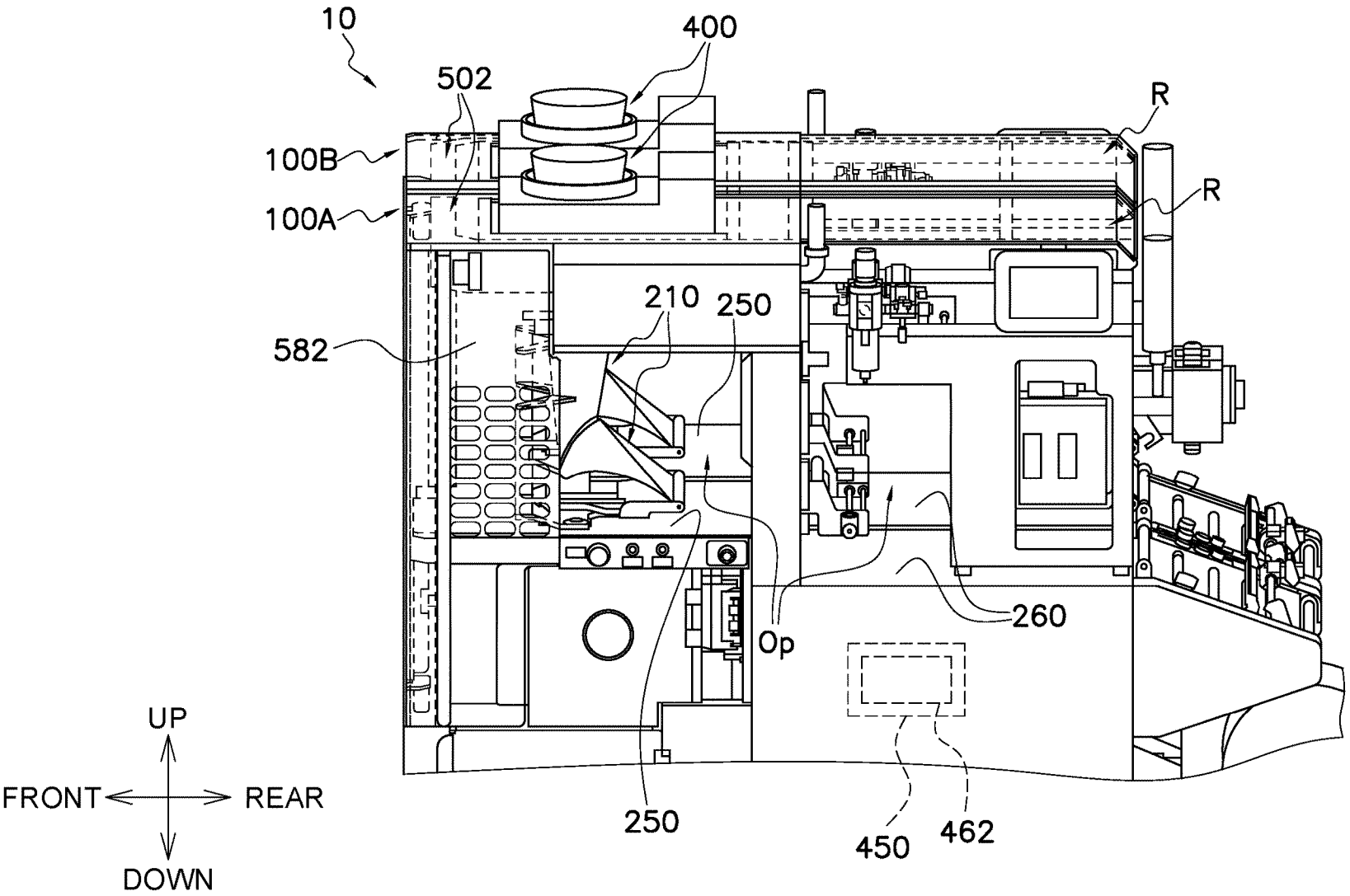
FIG. 6 is a schematic view of the bagmaking and packaging apparatus of FIG. 3 as viewed from the upper right.
Figure 7:
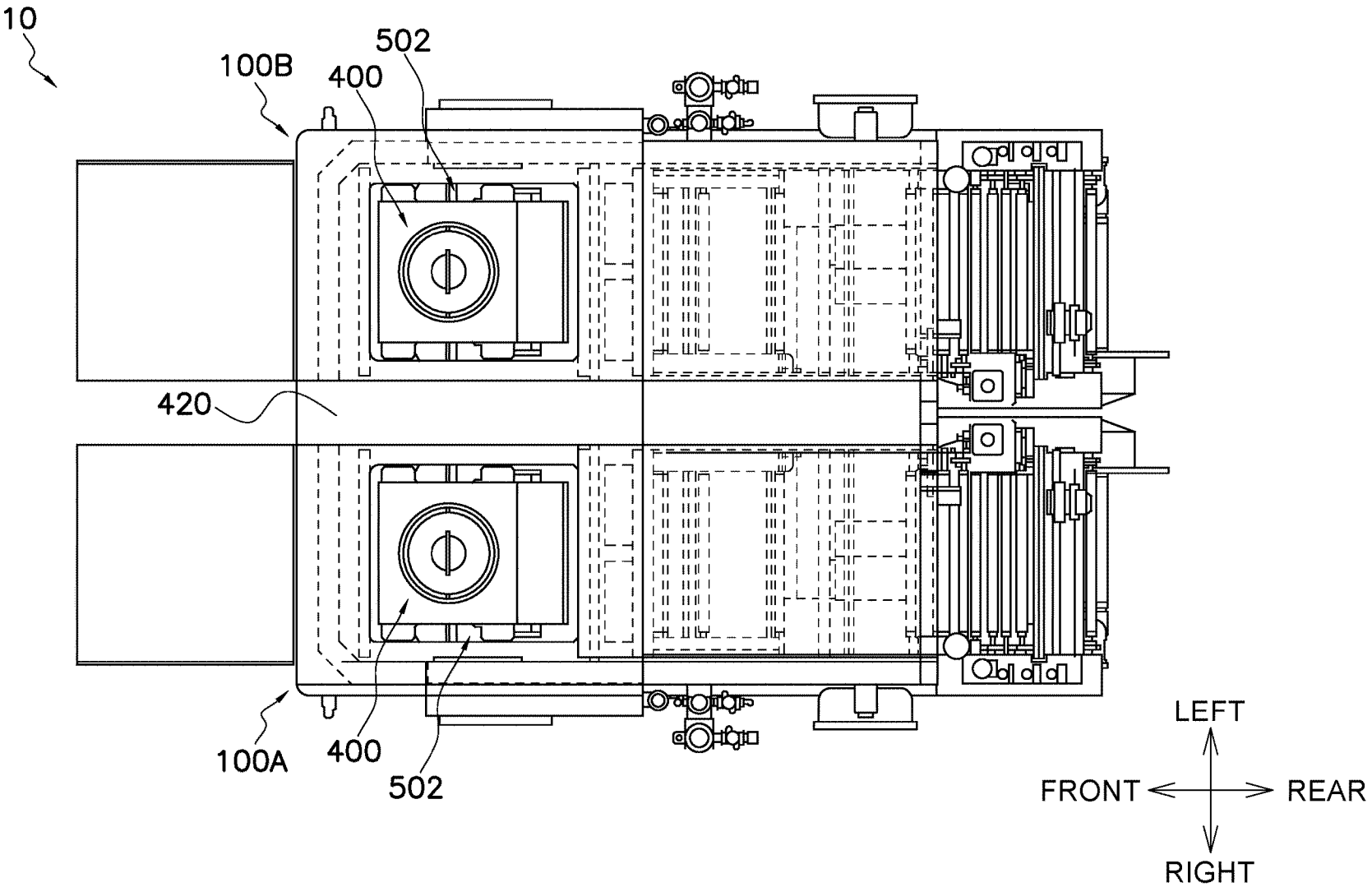
FIG. 7 is a schematic top view of the bagmaking and packaging apparatus of FIG. 3.
Figure 8:
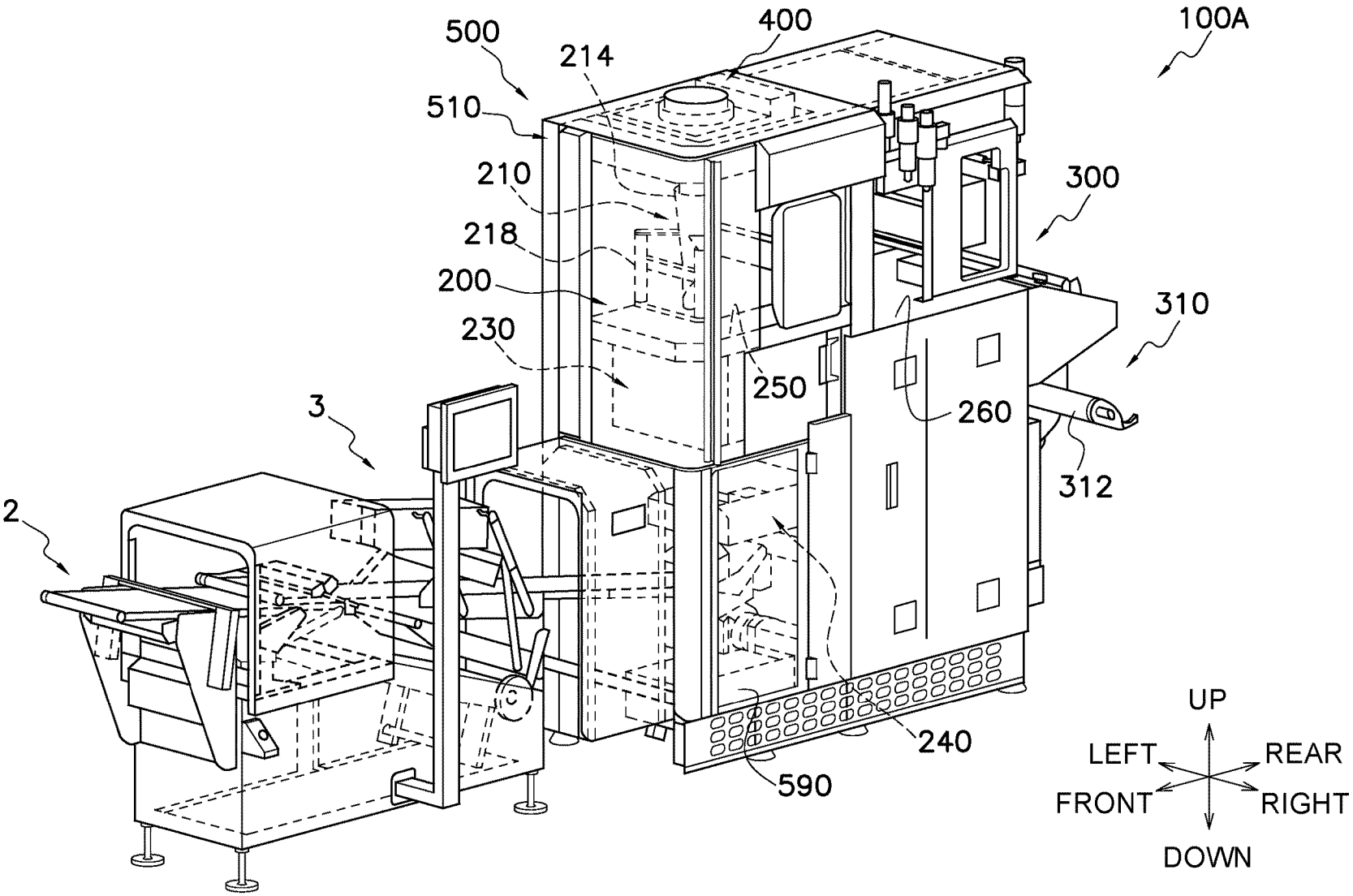
FIG. 8 is a schematic perspective view of the bagmaking and packaging machine disposed on the right side of the bagmaking and packaging apparatus of FIG. 3.
Figure 9:
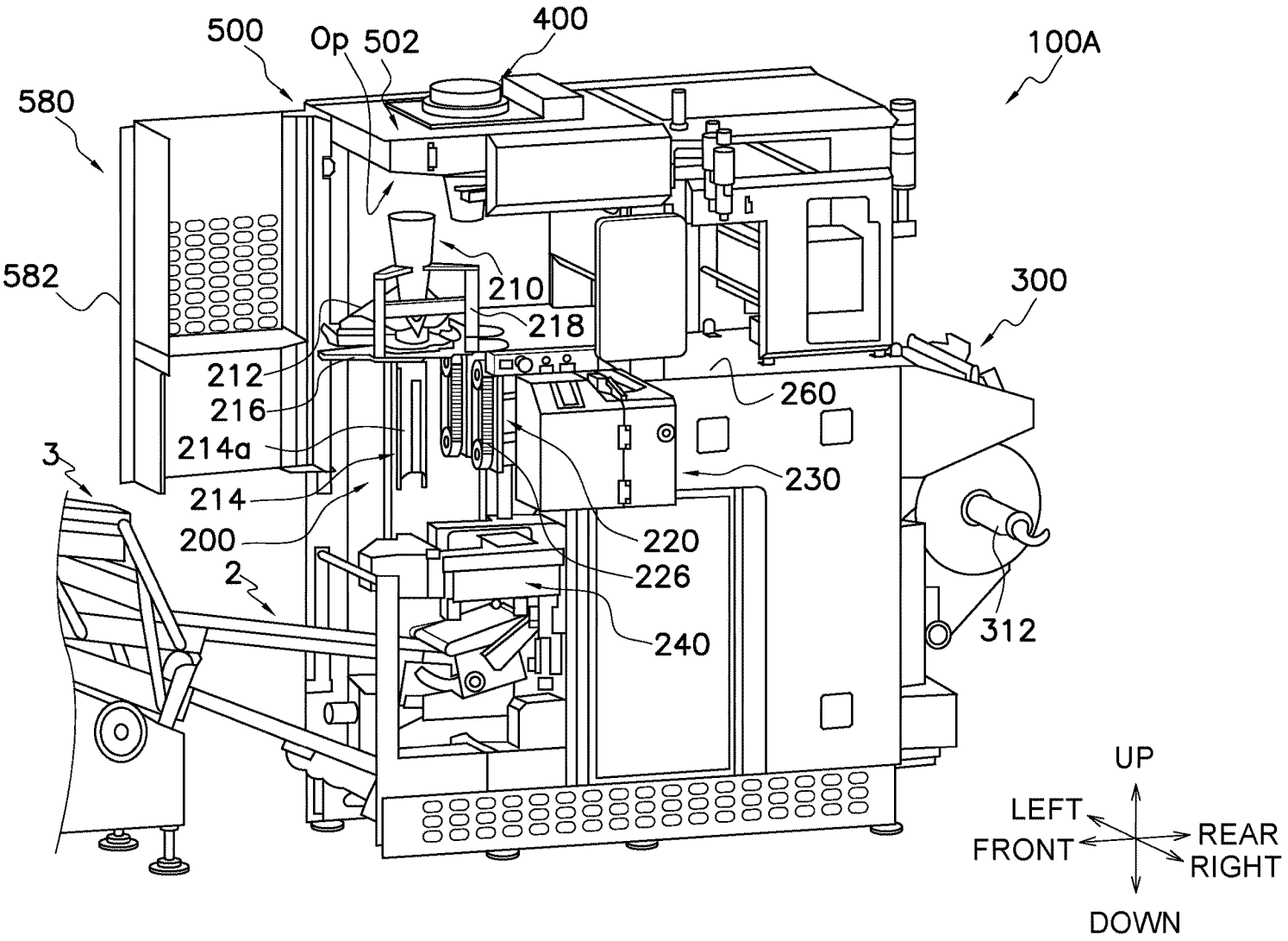
FIG. 9 is a schematic perspective view of the bagmaking and packaging machine of FIG. 8 from another angle.
Figure 10:
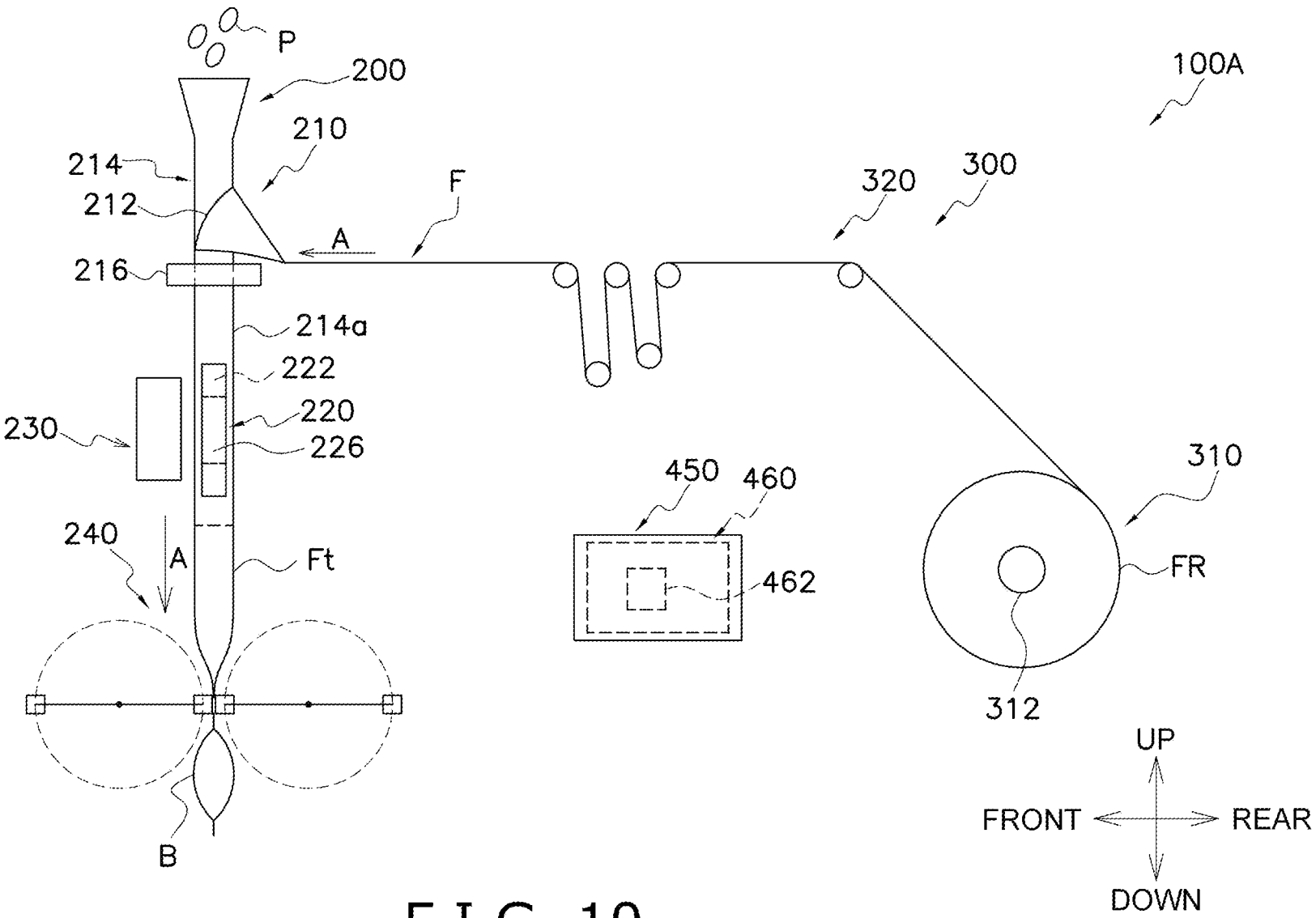
FIG. 10 is a schematic view of the configuration of the bagmaking and packaging machine of FIG. 8.

The bagmaking and packaging apparatus 10 will now be described in detail with further reference to FIG. 3 to FIG. 10. FIG. 3 is a view of the schematic configuration of the bagmaking and packaging apparatus 10. FIG. 4 is a view illustrating the insides of covers 580 of the bagmaking and packaging machines 100A, 100B of the bagmaking and packaging apparatus 10. FIG. 5 is a schematic front elevation view of the bagmaking and packaging apparatus 10. FIG. 6 is a schematic view of the bagmaking and packaging apparatus 10 as viewed from the upper right. FIG. 7 is a schematic top view of the bagmaking and packaging apparatus 10. FIG. 8 is a schematic perspective view of the bagmaking and packaging machine 100A disposed on the right side of the bagmaking and packaging apparatus 10. FIG. 9 is a schematic perspective view of the bagmaking and packaging machine 100A as viewed from a different angle from that of FIG. 8. It will be noted that FIG. 9 illustrates a state in which a later-described door 582 disposed on the front upper portion of the bagmaking and packaging machine 100A is open and a protective plate 590 (see FIG. 8) disposed on the front lower portion of the bagmaking and packaging apparatus 10 is detached. Furthermore, FIG. 9 illustrates a state in which, for the purpose of maintenance or the like, a later-described former mechanism 210 and longitudinal sealing mechanism 230 have been moved from the positions they are in when the bagmaking and packaging apparatus 10 is operating. FIG. 10 is a view of the schematic configuration of the bagmaking and packaging machine 100A.

In the bagmaking and packaging apparatus 10, as shown in FIG. 3 and other drawings, the two bagmaking and packaging machines 100A, 100B are installed side by side in the left and right direction.

The bagmaking and packaging machine 100A and the bagmaking and packaging machine 100B are disposed a distance of 10 mm to 30 mm apart, for example, without making a big gap between them in the left and right direction when the bagmaking and packaging apparatus 10 is viewed from the front. As a result, a maximum width W2 of the bagmaking and packaging apparatus 10 is narrower than the width W1 of the base member 690 of the combination weighing apparatus 600.

There is a slight gap between the bagmaking and packaging machine 100A and the bagmaking and packaging machine 100B. For that reason, the bagmaking and packaging apparatus 10 is provided with a gap-closing member 420 that closes off this gap (see FIG. 4 and FIG. 7). The gap-closing member 420 is a tabular member extending in the front and rear direction, though this is not intended to limit its shape. The gap-closing member 420 is, for example, disposed flush with first partition plates 250 and second partition plates 260 of the bagmaking and packaging machines 100A, 100B described later. Furthermore, instead of, or in addition to, being installed in the aforementioned position, the gap-closing member 420 may be installed between top plates 502 and frames 500 that support metal inspection devices 400 of the two bagmaking and packaging machines 100A, 100B. The gap-closing member 420 prevents debris such as fragments of the product P falling from above from falling onto the floor between the bagmaking and packaging machine 100A and the bagmaking and packaging machine 100B.

Furthermore, preferably, the bagmaking and packaging machines 100A, 100B have a line-symmetrical structure in the left and right direction as shown in FIG. 3 to FIG. 7. Here, the recitation that the bagmaking and packaging machine 100A and the bagmaking and packaging machine 100B are disposed be bilaterally symmetrical to each other means that the main configurations of the bagmaking and packaging machine 100A and the main configurations of the bagmaking and packaging machine 100B are disposed symmetrical to each other in the left and right direction.

Furthermore, it is preferred that each of the bagmaking and packaging machines 100A, 100B has an opening Op in at least part of its side surface that opposes the other bagmaking and packaging machine 100A, 100B. Particularly when the bagmaking and packaging machines 100A, 100B have a line-symmetrical structure in the left and right direction, the inside space of the bagmaking and packaging machine 100A and the inside space of the bagmaking and packaging machine 100B communicate with each other via the openings Op.

Figure 13:
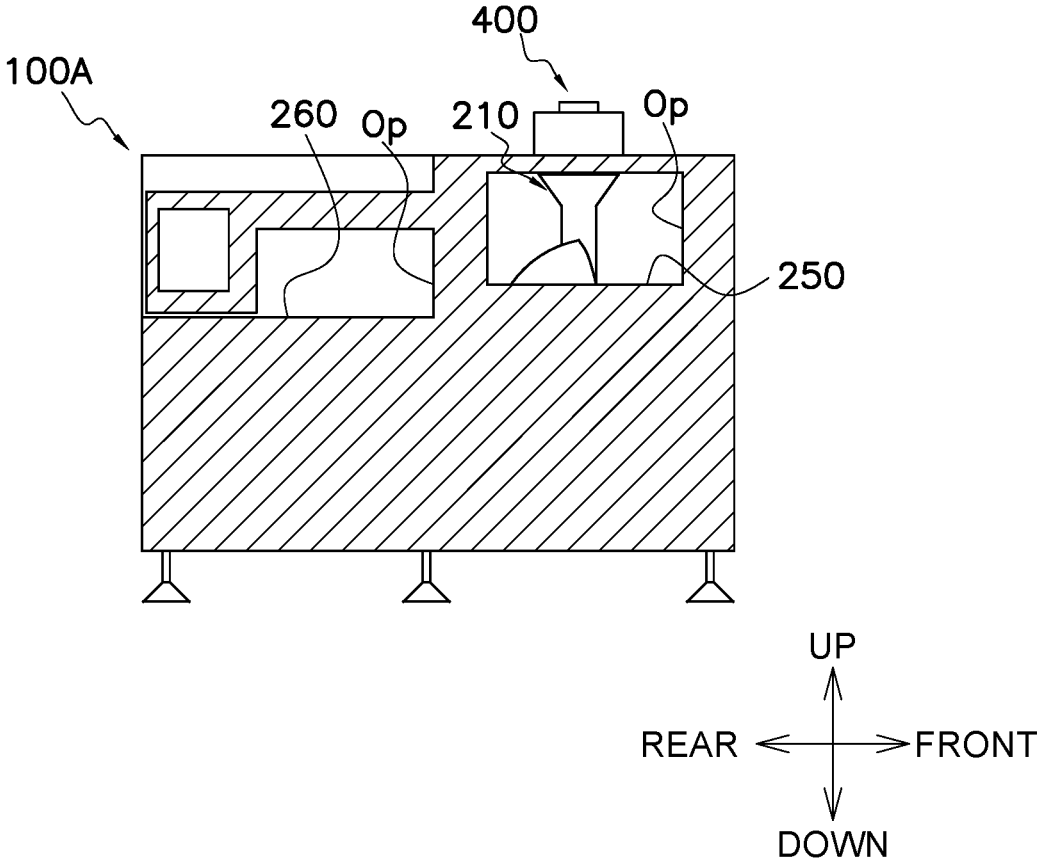
FIG. 13 is a view schematically illustrating a state in which the bagmaking and packaging machine of FIG. 8 is viewed from the left side thereof.

The openings Op will be described with reference to FIG. 13, which schematically shows the bagmaking and packaging machine 100A as viewed from the left side (the side adjacent to the bagmaking and packaging machine 100B). The hatched portion in FIG. 13 represents the position where a cover that covers the frame and the apparatus is attached (i.e., a position where there is a member), and the non-hatched portions represent the openings Op. When the bagmaking and packaging machine 100B and the bagmaking and packaging machine 100A are configured to be bilaterally symmetrical to each other, the openings Op in the two bagmaking and packaging machines 100A, 100B allow the space inside a later-described frame 500 of the bagmaking and packaging machine 100A to communicate with the space inside a later-described frame 500 of the bagmaking and packaging machine 100B. For example, the space above a first partition plate 250 of a bagmaking and packaging unit 200 of the bagmaking and packaging machine 100A and the space above a first partition plate 250 of a bagmaking and packaging unit 200 of the bagmaking and packaging machine 100B form a continuous space V as shown in FIG. 4 because of the presence of the openings Op. The same is also true of the space above a second partition plate 260 of a film supply unit 300 of the bagmaking and packaging machine 100A and the space above a second partition plate 260 of a film supply unit 300 of the bagmaking and packaging machine 100B.

For this reason, for example, by blowing in air from the left side of the bagmaking and packaging machine 100B on the left side, debris present in the space inside the bagmaking and packaging machine 100B and in the space inside the bagmaking and packaging machine 100A can be moved by the force of the air to the right end of the bagmaking and packaging machine 100A on the right side. Particularly in the bagmaking and packaging apparatus 10 of the present embodiment, the presence of the first partition plates 250 and the second partition plates 260 of the bagmaking and packaging machines 100A, 100B and the gap-closing member 420 can prevent debris from falling below the first partition plates 250 and the second partition plates 260 and the gap-closing member 420. Furthermore, the first partition plate 250 and the second partition plate 260 of the bagmaking and packaging machine 100A may be inclined so that their gap-closing member 420 sides (left end sides) are higher than their right end sides, and the first partition plate 250 and the second partition plate 260 of the bagmaking and packaging machine 100B may be inclined so that their gap-closing member 420 sides (right end sides) are higher than their left end sides. This makes it even easier to remove debris.

(3-1) Bagmaking and Packaging Machines

The bagmaking and packaging machine 100A will now be described in detail. It will be noted that because the bagmaking and packaging machine 100B has the same structure as the bagmaking and packaging machine 100A except for being disposed bilaterally symmetrical to it, description of the bagmaking and packaging machine 100B will be omitted unless necessary.

The bagmaking and packaging machine 100A makes a bag-type packaging material from a sheet-form film F to make bags B containing the product P inside (see FIG. 10). The product P contained in the bags B is supplied from the combination weighing machine 610A disposed above the bagmaking and packaging machine 100A (from the combination weighing machine 610B, in a case where the bagmaking and packaging machine 100B).

It will be noted that the bags B made by the bagmaking and packaging machine 100A are conveyed by a conveyance apparatus 2 and that seals of the bags B are checked by a seal checker 3 as the bags B are being conveyed by the conveyance apparatus 2 (see FIG. 8).

As shown in FIG. 8 to FIG. 10, the bagmaking and packaging machine 100A mainly includes a film supply unit 300, a bagmaking and packaging unit 200, a metal inspection device 400, a frame 500, a control unit 460, a first partition plate 250, and a second partition plate 260.

The film supply unit 300 is disposed in the rear portion of the bagmaking and packaging machine 100A. The film supply unit 300 supplies the sheet-form film F to the bagmaking and packaging unit 200 disposed forward of the film supply unit 300. The bagmaking and packaging unit 200 is disposed in the front portion of the bagmaking and packaging machine 100A. The bagmaking and packaging unit 200 forms the sheet-form film F in a tubular shape and transversely seals a tubular film Ft formed in the tubular shape to make the bags B. The metal inspection device 400 inspects for metal contaminants in the product P dropped and supplied from the combination weighing machine 600A to the bagmaking and packaging machine 100A. The frame 500 mainly supports the film supply unit 300, the bagmaking and packaging unit 200, and the metal inspection device 400. The control unit 460 controls the operation of each part of the film supply unit 300 and the bagmaking and packaging unit 200 and performs various operations and processes. The first partition plate 250 partitions the space above the first partition plate 250 from the space under it. The second partition plate 260 partitions the space above the first partition plate 260 from the space under it. The positions where the first partition plate 250 and the second partition plate 260 are disposed will be described later.

(3-1-1) Film Supply Unit

The film supply unit 300 is disposed in the rear portion of the bagmaking and packaging machine 100A. The film supply unit 300 is disposed rearward of the bagmaking and packaging unit 200 and next to the bagmaking and packaging unit 200. The film supply unit 300 supplies the sheet-form film F to a later-described former mechanism 210 of the bagmaking and packaging unit 200 disposed forward of the film supply unit 300.

As shown in FIG. 10, the film supply unit 300 mainly includes a film roll support mechanism 310 and a guide mechanism 320.

The film roll support mechanism 310 holds a film roll FR in which the sheet-form film F is wound about a core (not shown in the drawings). The film roll support mechanism 310 uses a drive unit such as a motor (not shown in the drawings) to rotate a shaft 312 to which the core of the film roll FR is attached (see FIG. 8 to FIG. 10) and pay out the film F from the film roll FR.

The guide mechanism 320 includes a plurality of rollers disposed along a conveyance path R of the film F. The guide mechanism 320 guides to the former mechanism 210 of the bagmaking and packaging unit 200 the film F paid out from the film roll FR.

(3-1-2) Second Partition Plate

The second partition plate 260 is a plate-shaped member disposed in the rear portion of the bagmaking and packaging machine 100A and under the conveyance path R of the film F guided by the guide mechanism 320 of the film supply unit 300 (see FIG. 6). The second partition plate 260 partitions the space above the second partition plate 260, in which the film F is conveyed, from the space under the second partition plate 260.

Preferably, in the space under the second partition plate 260, a housing unit (control box) 450 that houses a circuit board 462 of the control unit 460 described later is disposed. In other words, it is preferred that the housing unit 450 that houses the circuit board 462 be disposed under the conveyance path R of the film F in the film supply unit 300. By disposing the housing unit 450 in this position, the transverse width of the bagmaking and packaging apparatus 10 is easily reduced compared with, for example, disposing the housing unit 450 on the right side of the bagmaking and packaging machine 100A. Furthermore, by disposing the housing unit 450 in this position, the height of the bagmaking and packaging apparatus 10 is easily reduced compared with disposing the housing unit 450 above the conveyance path R of the film F in the film supply unit 300, and the front and rear direction length of the bagmaking and packaging apparatus 10 is easily reduced compared with disposing the housing unit 450 rearward of the conveyance path R of the film F in the film supply unit 300.

Moreover, the second partition plate 260 inhibits debris from falling from above, so the occurrence of a situation where debris adversely affects the circuit board 462 is easily reduced in the space under the second partition plate 260. However, the presence of the second partition plate 260 may not be provided.

(3-1-3) Bagmaking and Packaging Unit

As shown in FIG. 10, the bagmaking and packaging unit 200 mainly includes a former mechanism 210, a conveyance mechanism 220, a longitudinal sealing mechanism 230, and a transverse sealing mechanism 240.

The former mechanism 210 mainly includes a former 212, a tube 214, a base 216, and a grip unit 218.

The former 212 is disposed so as to surround the tubular tube 214 and forms in a tubular shape the sheet-form film F conveyed thereto from the film supply unit 300 in the rear portion of the bagmaking and packaging machine 100A by bending the film F so that left and right end portions of the film F (end portions in the width direction of the film F) overlap each other. The tubular film Ft formed by the former 212 is guided so as to become wrapped around the outer peripheral surface of the lower portion of the tubular tube 214 and is conveyed downward in a state in which it is wrapped around the tube 214.

The tube 214 is a tubular member that extends in the vertical direction and has upper and lower end portions that are open. The tube 214 receives the falling product P in its upper opening and supplies, from its lower opening to the inside of the tubular film Ft, the product P fed through the upper opening.

The base 216 is mounted on, and secured to, a mount (not shown in the drawings) provided on a first partition plate 250 described later. The former 212 and the tube 214 are attached to the base 216 directly or via another member, and the base 216 supports the former 212 and the tube 214. The grip unit 218 is also attached to the base 216 directly or via another member. When attaching the former mechanism 210 to the mount or detaching the former mechanism 210 from the mount, a worker grips hold of the grip unit 218 and moves the former mechanism 210.

The conveyance mechanism 220 is disposed under the base 216. The conveyance mechanism 220 is disposed on the left and right sides of a portion 214*a* of the tube 214 around which the tubular film Ft is wrapped. The conveyance mechanism 220 conveys to the former mechanism 210 the film F paid out from the film roll FR and conveys to the transverse sealing mechanism 240 the tubular film Ft formed by the former 212. The conveyance mechanism 220 has pull-down belts 226 having a suction function, and the conveyance mechanism 220 conveys the tubular film Ft downward as a result of drive rollers 222 around which the pull-down belts 226 are entrained being driven by a drive mechanism such as a motor (not shown in the drawings) in a state in which the pull-down belts 226 are sucking hold of the film F.

The longitudinal sealing mechanism 230 seals the overlapping portion of the tubular film Ft at which the left and right end portions of the tubular film Ft overlap each other. The longitudinal sealing mechanism 230 is disposed in front of a path on which is conveyed the overlapping portion of the tubular film Ft, which is conveyed in a state in which the tubular film Ft is wrapped around the tube 214. The longitudinal sealing mechanism 230 has a built-in heater (not shown in the drawings) inside. When the longitudinal sealing mechanism 230 with its heater turned on is driven by a drive unit (not shown in the drawings) so that the longitudinal sealing mechanism 230 is pressed against the tube 214 via the tubular film Ft, the overlapping portion of the tubular film Ft is sealed in the up and down direction (the longitudinal direction).

As shown in FIG. 10, the transverse sealing mechanism 240 is disposed under the longitudinal sealing mechanism 230. The transverse sealing mechanism 240 transversely seals the top and bottom of a segment of the tubular film Ft corresponding to one bag B (used to make one bag B) to make a bag B containing the product P. Specifically, the transverse sealing mechanism 240 transversely seals, in a direction orthogonal to a conveyance direction A of the tubular film Ft, the longitudinally sealed tubular film Ft conveyed downward by the conveyance mechanism 220 to thereby form transverse seal portions of the bag B.

(3-1-4) First Partition Plate

The first partition plate 250 is an example of a partition plate, and is a plate-shaped member disposed under the base 216 of the former mechanism 210 and above the transverse sealing mechanism 240 (see FIG. 4, FIG. 6, and FIG. 8). The first partition plate 250 inhibits debris from falling onto the longitudinal sealing mechanism 230 and the transverse sealing mechanism 240, which are disposed under the first partition plate 250.

The first partition plate 250 is disposed so as to surround the former mechanism 210. In the first partition plate 250, a through hole (not shown in the drawings) is formed vertically through the first partition plate 250, and the tube 214 of the former mechanism 210 is inserted into this through hole. It is preferred that the through hole be entirely covered by the base 216 of the former mechanism 210 when viewed in a top view.

(3-1-5) Metal Inspection Device

The metal inspection device 400 is disposed above the upper end of the tube 214 of the former mechanism 210. In other words, the metal inspection device 400 is disposed above the former mechanism 210. The metal inspection device 400 inspects for metal contaminants in the product P dropped and supplied from the combination weighing machine 610A to the opening in the upper end of the tube 214. The metal inspection device 400 is supported by the frame 500 and a top plate 502 mounted on the frame 500 (see FIG. 9). The top plate 502 is divided into front and back plates, and by detaching one, it becomes easy to access the metal inspection device 400 and easy to perform cleaning and maintenance. The metal inspection device 400 itself is a known device, so detailed description thereof will be omitted.

(3-1-6) Control Unit

The control unit 460 is disposed under the conveyance path R of the film F in the film supply unit 300. The control unit 460 controls the operations of the various configurations of the bagmaking and packaging apparatus 10. It will be noted that the expression that each of the bagmaking and packaging machines 100A, 100B has the control unit 460 also includes a case where one device functions as the control unit 460 for the bagmaking and packaging machine 100A and the control unit 460 for the bagmaking and packaging machine 100B.

The control unit 460 includes the circuit board 462 on which various types of electronic components are installed. The electronic components installed on the circuit board 462 include, for example, a CPU and a memory. The control unit 460 controls the operations of the various configurations of the bagmaking and packaging apparatus 10, such as the film supply units 300 as well as the conveyance mechanisms 220, the longitudinal scaling mechanisms 230, and the transverse sealing mechanisms 240 of the bagmaking and packaging units 200, as a result of the CPU reading and executing programs stored in the memory.

The circuit board 462 is disposed in the housing unit (control box) 450. The housing unit 450 is disposed rearward of the former mechanism 210 and the transverse scaling mechanism 240. Conventionally, a circuit board housing unit is disposed on the left side or the right side of the bagmaking and packaging machine 100A. In contrast, by disposing the circuit board housing unit rearward of the former mechanism 210 and the transverse scaling mechanism 240, the transverse width of the bagmaking and packaging apparatus 10 is easily reduced. Particularly by disposing the housing unit 450 under the conveyance path R of the film F in the film supply unit 300 as described above, the size of the bagmaking and packaging machine 100A, and therefore of the bagmaking and packaging apparatus 10, is easily reduced.

(3-1-7) Frame

Figure 11:
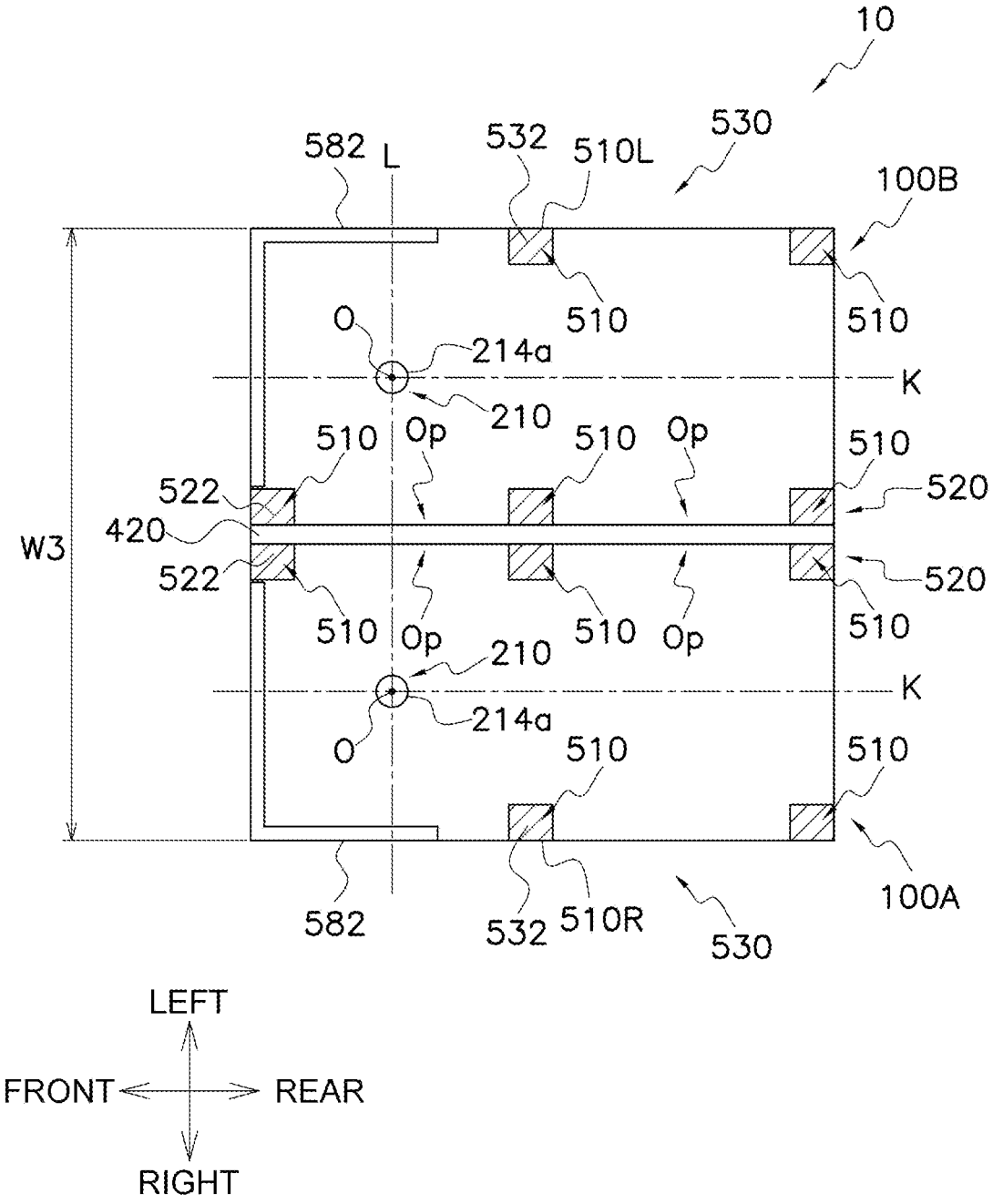
FIG. 11 is a schematic plan view illustrating the arrangement of support posts of the bagmaking and packaging apparatus of FIG. 3.
Figure 12:
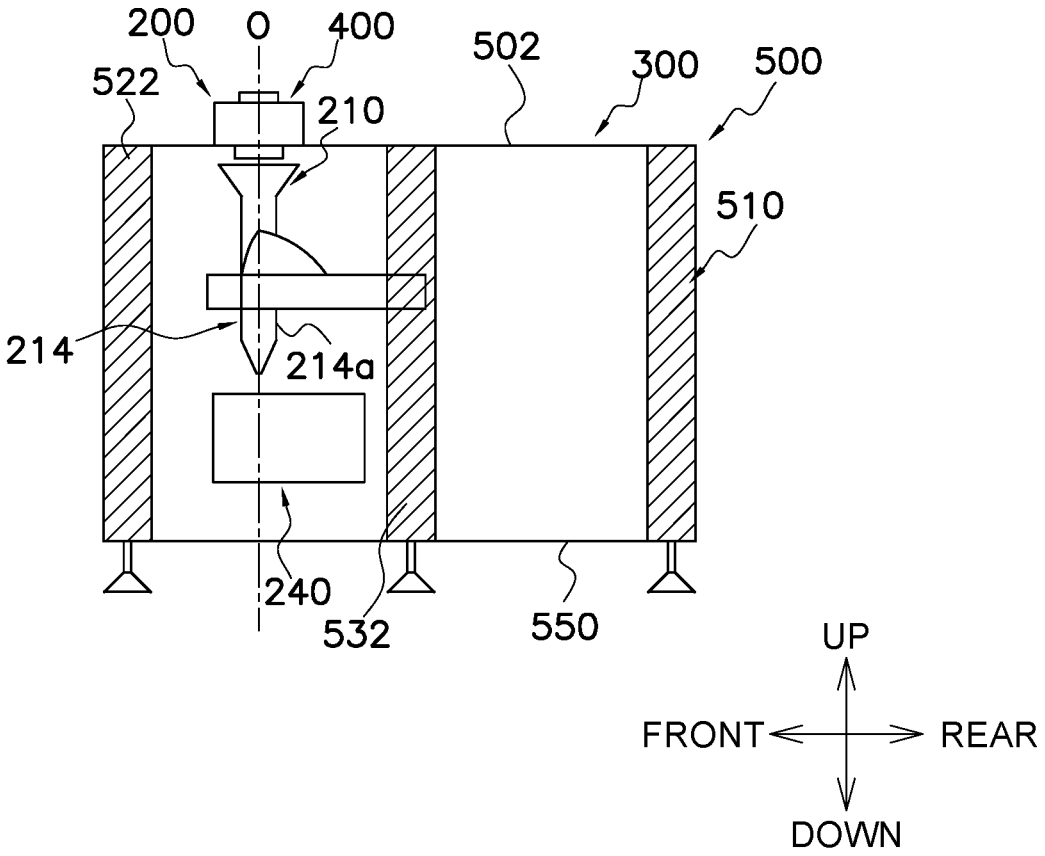
FIG. 12 is a schematic side view illustrating the arrangement of the support posts of a frame of the bagmaking and packaging machine of FIG. 8.

The frame 500 will now be described with reference to FIG. 11 and FIG. 12. FIG. 11 is a schematic plan view illustrating the arrangement of support posts 510 of the bagmaking and packaging apparatus 10. FIG. 12 is a schematic right side view illustrating the arrangement of the support posts 510 of the frame 500 of the bagmaking and packaging machine 100A. It will be noted that in FIG. 11 and FIG. 12 hatching has been added to the support posts 510 from the standpoint of facilitating understanding of the drawings.

The frame 500 of the bagmaking and packaging machine 100A supports various devices and parts of the film supply unit 300, various devices and parts of the bagmaking and packaging unit 200, and the metal inspection device 400 of the bagmaking and packaging machine 100A.

The frame 500 includes, for example, multiple upright support posts 510 and beams that bridge the support posts 510. In other words, the frame 500 is configured by, for example, the support posts 510 and the beams. Here, particularly the support posts 510 will be mainly described. It will be noted that the support posts 510 here are posts whose upper ends are disposed in a position higher than the transverse sealing mechanism 240.

The frame 500 including the support posts 510 surrounds at least part of each of the film supply unit 300, the former mechanism 210, and the transverse sealing mechanism 240.

Here, that the frame 500 surrounds at least part of the film supply unit 300 means that, when viewed from above, at least part of the film supply unit 300 is disposed in an area (in the rectangle in FIG. 11) defined by a virtual line extending in the left and right direction and passing through the support post 510 disposed foremost, a virtual line extending in the left and right direction and passing through the support posts 510 disposed rearmost, a virtual line extending in the front and rear direction and passing through the support posts 510 disposed rightmost, and a virtual line extending in the front and rear direction and passing through the support posts 510 disposed leftmost. The same is true of the expression that the frame 500 surrounds at least part of each of the former mechanism 210 and the transverse sealing mechanism 240.

The support posts 510 include a first support post group 220 including a plurality of the support posts 510 disposed on the side of the bagmaking and packaging machine 100A adjacent to the bagmaking and packaging machine 100B (here, the left side) in the left and right direction (relative to a virtual line K extending in the front and rear direction through the left and right direction center of the bagmaking and packaging machine 100A) and a second support post group 530 including a plurality of the support posts 510 disposed on the side of the bagmaking and packaging machine 100A not adjacent to the bagmaking and packaging machine 100B (here, the right side) in the left and right direction (see FIG. 11). It will be noted that, here, because the bagmaking and packaging machine 100B has a line-symmetrical structure in the left and right direction with the bagmaking and packaging machine 100A, in the bagmaking and packaging machine 100B, the first support post group 520 includes a plurality of the support posts 510 disposed on the right side adjacent to the bagmaking and packaging machine 100A, and the second support post group 530 includes a plurality of the support posts 510 disposed on the left side not adjacent to the bagmaking and packaging machine 100A (see FIG. 11).

In the bagmaking and packaging machine 100A, the multiple support posts 510 are arranged asymmetrically relative to the virtual line K extending through the left and right direction center of the bagmaking and packaging machine 100A.

Specifically, a first support post 522 disposed foremost among the support posts 510 of the first support post group 520 is disposed forward of a center O of the tube 214 (forward of a virtual line L passing through the center O) when viewed from above. More preferably, the first support post 522 is disposed forward of the tube 214 (in particular, here, the portion 214*a* of the tube 214 around which the tubular film Ft formed in the tubular shape by the former 212 is wrapped). In contrast, a second support post 532 disposed foremost among the support posts 510 of the second support post group 530 is disposed rearward of the center O of the tube 214 (rearward of the virtual line L passing through the center O) when viewed from above. More preferably, the second support post 532 is disposed rearward of the portion 214*a* of the tube 214.

It will be noted that here, the center O of the tube 214 means the position of the center of gravity of a cross-section obtained by horizontally cutting the portion 214*a* of the tube 214. For example, if the cross-sectional shape of the portion 214*a* of the tube 214 is circular, the center O of the tube 214 is the center of the cross-section obtained by horizontally cutting the portion 214*a* of the tube 214. It will be noted that the cross-sectional shape of the portion 214*a* of the tube 214 may also be a shape other than a circular shape, such as an oval shape for example.

The first support post 522 extends from a position lower than the transverse sealing mechanism 240 to a position higher than the transverse sealing mechanism 240. Furthermore, the second support post 532 also extends from a position lower than the transverse scaling mechanism 240 to a position higher than the transverse sealing mechanism 240. For example, specifically, the first support post 522 and the second support post 532 extend from a base 550 in the bottom portion of the bagmaking and packaging machine 100A to a position higher than the upper end of the tube 214 of the former mechanism 210.

The first support post 522 and the second support post 532, for example, directly or indirectly support the former mechanism 210. Furthermore, particularly the first support post 522 supports the metal inspection device 400 that is a heavy object disposed higher than the former mechanism 210. Furthermore, the first support post 522 supports a cover 580 of the bagmaking and packaging machine 100A.

Here, the cover 580 is a member that covers the front side and the right side of the former mechanism 210. The cover 580 is attached to the first support post 522, and the first support post 522 supports the cover 580. It will be noted that the cover 580 that covers the front side and the right side includes a door 582 that can be opened and closed. During maintenance, for example, a worker can access the former mechanism 210, the conveyance mechanism 220, and the longitudinal sealing mechanism 230 by swinging the door 582 on hinges provided on the first support post 522 (see FIG. 9). Furthermore, the cover 580 may be configured to cover the beams of the frame 500. Because of this, debris can be better reduced from entering between the cover 580 and the frame 500. It will be noted that from the standpoint of maintainability, it is preferred that part of the first partition plate 250 be attached to the door 582, so that part of the first partition plate 250 moves together with the door 582 when the door 582 is opened. When the first partition plate 250 is configured in this way, the first partition plate 250 becomes less likely to get in the way of the worker, and the bagmaking and packaging apparatus 10 with high maintainability can be realized.

It will be noted that it is preferred that a distance W3 between a right end 510R of the support posts 510 disposed rightmost and a left end 510L of the support posts 510 disposed leftmost in the entire bagmaking and packaging apparatus 10 be smaller than the maximum width W2 of the bagmaking and packaging apparatus 10 (see FIG. 1). This makes it particularly easy for the left and right direction width of the space required to install the weighing and packaging system 1 to be reduced.

Advantageous effects obtained by arranging the support posts 510 as in FIG. 11 and FIG. 12 will now be described.

One advantage of the structure of the frame 500 of the bagmaking and packaging machine 100A is that it is easy to ensure, on the side where the second support post group 530 is disposed (here, the right side) in the left and right direction, work space for the former mechanism 210 and the like. Specifically, as shown in FIG. 9, when a worker opens the door 582 of the cover 580, it is easy for the worker to enter the frame 500 from the right side or the right front side of the bagmaking and packaging machine 100A, grip hold of the grip unit 218 of the former mechanism 210, and detach the former mechanism 210 from the bagmaking and packaging machine 100A, because on the right side of the bagmaking and packaging machine 100A there is no support post 510 at least in front of the center O of the tube 214. Furthermore, because on the right side of the bagmaking and packaging machine 100A there is no support post 510 at least forward of the center O of the tube 214, detachment of the former mechanism 210 is less likely to be obstructed by a support post 510.

Another advantage of this structure is the stability of the structure of the frame 500. Specifically, because the first support post 522 is disposed forward of the center O of the tube 214 on the side in the left and right direction where the first support post group 520 is disposed (here, the left side), a heavy object like the metal inspection device 400 disposed above the former mechanism 210 (particularly, in the present embodiment, the metal inspection device 400 is disposed forward of the center O of the tube 214 as in FIG. 12), as well as the cover 580 disposed around the former mechanism 210 can be solidly supported.

It will be noted that because there is a possibility for debris to accumulate between the lower end of the cover 580 and the floor, a hole that is long in the horizontal direction may be provided under the cover 580 so that a nozzle for blowing air can be inserted through the hole.

(4) Characteristics of Bagmaking and Packaging Apparatus and Weighing and Packaging System

4-1

The bagmaking and packaging apparatus 10 includes the two bagmaking and packaging machines 100A, 100B installed side by side in the left and right direction. Each of the bagmaking and packaging machines 100A, 100B includes the film supply unit 300, the former mechanism 210, the transverse sealing mechanism 240, and the control unit 460. The film supply unit 300 is disposed in the rear portion of the bagmaking and packaging machines 100A, 100B. The former mechanism 210 is disposed in the front portion of the bagmaking and packaging machines 100A, 100B. The former mechanism 210 has the former 212 and the tube 214, and forms in the tubular shape the sheet-form film F supplied from the film supply unit 300 in the rear portion of the bagmaking and packaging machines 100A, 100B. The transverse sealing mechanism 240 is disposed below the former mechanism 210 and transversely seals a top and a bottom of the tubular film Ft into which the product P supplied from above is fed. The control unit 460 controls the operations of the film supply unit 300 and the transverse sealing mechanism 240. Each of the bagmaking and packaging machines 100A, 100B is disposed under the discharge chute 670 of a corresponding one of the combination weighing machines 610A, 610B of the combination weighing apparatus 600. The combination weighing apparatus 600 includes the two combination weighing machines 610A, 610B joined to each other substantially symmetrically in the left and right direction as viewed in a top view, and the base member 690 that integrally supports the combination weighing machines 610A, 610B. Each of the combination weighing machines 610A, 610B supplies the product P to the insides of the weigh hoppers 650 arranged along part of a circle and combines and discharges the product P being retained inside one or more of the weigh hoppers 650 selected in accordance with the target weight. The maximum width W2 of the bagmaking and packaging apparatus 10 when viewed from the front is narrower than the width W1 of the base member 690.

In the bagmaking and packaging apparatus 10, the width of the space required to install the weighing and packaging system 1 including the bagmaking and packaging apparatus 10 and the combination weighing apparatus 600 can be reduced.

4-2

In the bagmaking and packaging apparatus 10, each of the bagmaking and packaging machines 100A, 100B includes the housing unit (control box) 450 that houses the circuit board 462 of the control unit 460. The housing unit 450 is disposed rearward of the former mechanism 210 and the transverse sealing mechanism 240.

In the bagmaking and packaging apparatus 10, the circuit board 462 of the control unit 460 is disposed not on the left and right sides of the bagmaking and packaging machines 100A, 100B but rearward of the former mechanism 210 and the transverse scaling mechanism 240. Thus, an increase in the left and right width of the space needed to install the bagmaking and packaging apparatus 10 can be reduced.

4-3

In the bagmaking and packaging apparatus 10, the housing unit 450 is disposed under the conveyance path R of the film F in the film supply unit 300.

In the bagmaking and packaging apparatus 10, because the housing unit 450 that houses the circuit board 462 is disposed under the film supply unit 300, space can be effectively utilized to realize the compact bagmaking and packaging apparatus 10. Furthermore, in the bagmaking and packaging apparatus 10, the front and rear direction width of the space required to install the weighing and packaging system 1 can also be reduced compared with disposing the housing unit 450 rearward of the film supply unit 300.

4-4

In the bagmaking and packaging apparatus 10, each of the bagmaking and packaging machines 100A, 100B includes the plurality of upright support posts 510. The support posts 510 configure the frame 500 that surrounds at least part of each of the film supply unit 300, the former mechanism 210, and the transverse sealing mechanism 240. The distance W3 between the right end 510R of the support posts 510 disposed rightmost and the left end 510L of the support posts 510 disposed leftmost in the bagmaking and packaging apparatus 10 is smaller than the maximum width W2 of the bagmaking and packaging apparatus 10.

In the bagmaking and packaging apparatus 10, the distance W3 between the right end 510R of the support posts 510 disposed rightmost and the left end 510L of the support posts 510 disposed leftmost, which particularly affects the left and right width of the space needed to install the bagmaking and packaging apparatus 10, is smaller than the maximum width W2 of the bagmaking and packaging apparatus 10. For that reason, in the bagmaking and packaging apparatus 10, it is particularly easy for the left and right direction width of the space required to install the weighing and packaging system 1 to be reduced.

4-5

In the bagmaking and packaging apparatus 10, in the bagmaking and packaging machine 100B on the left side, the support post 510 (532) that is foremost on the left side is disposed rearward of the tube 214 of the former mechanism 210. In the bagmaking and packaging machine 100A on the right side, the support post 510 (532) that is foremost on the right side is disposed rearward of the tube 214 of the former mechanism 210.

In the bagmaking and packaging apparatus 10, space in which a worker can access devices such as the former mechanisms 210 inside the bagmaking and packaging machines 100A, 100B during maintenance such as cleaning is ensured on the left front side of the bagmaking and packaging machine 100B on the left side and on the right front side of the bagmaking and packaging machine 100A on the right side. As a result, in the bagmaking and packaging apparatus 10, the width of the space required to install the bagmaking and packaging apparatus 10 can be reduced while realizing the high maintainability.

4-6

In the bagmaking and packaging apparatus 10, the two bagmaking and packaging machines 100A, 100B have a substantially line-symmetrical structure in the left and right direction. Each of the bagmaking and packaging machines 100A, 100B has the opening Op in at least part of its side surface that opposes the other bagmaking and packaging machine 100B, 100A.

When the two bagmaking and packaging machines 100A, 100B are installed close to each other in the left and right direction, it is difficult to access each of the bagmaking and packaging machines 100A, 100B from the sides on which the bagmaking and packaging machines 100A, 100B are adjacent to each other. For that reason, space in which cleaning and such are difficult tends to arises on the side of each of the bagmaking and packaging machines 100A, 100B on which the two bagmaking and packaging machines 100A, 100B are in close proximity to each other.

However, in this bagmaking and packaging apparatus 10, because the openings Op are formed in mutually opposing surfaces, a space that is continuous from the right end to the left end of the bagmaking and packaging apparatus 10 is formed in the bagmaking and packaging apparatus 10. By configuring the bagmaking and packaging apparatus 10 in this way, dirt that has accumulated on the side of each of the bagmaking and packaging machines 100A/100B on which the two bagmaking and packaging machines 100A/100B are in close proximity to each other can be easily moved to the left side/right side of the bagmaking and packaging machine 100B/100A disposed on the left side/right side by, for example, blowing air in from the right side/left side of the bagmaking and packaging machine 100A/100B disposed on the right side/left side. As a result, in this bagmaking and packaging apparatus 10, the width of the installation space can be reduced while realizing the high cleanability.

4-7

The bagmaking and packaging apparatus 10 includes the gap-closing member 420 that is provided between the two bagmaking and packaging machines 100A, 100B and closes off the gap between the bagmaking and packaging machines 100A, 100B. The gap-closing member 420 is installed between the first partition plates 250 and between the second partition plates 260 or between the top plates and the frames 500 that support the metal inspection devices 400 of the two bagmaking and packaging machines 100A, 100B.

In this bagmaking and packaging apparatus 10, debris can be prevented from falling through the gap between the bagmaking and packaging machines 100A, 100B. Thus, the bagmaking and packaging apparatus 10 is hygienic.

4-8

In the bagmaking and packaging apparatus 10, each of the bagmaking and packaging machines 100A, 100B has the first partition plate 250 serving as an example of a partition plate that is disposed between the former mechanism 210 and the transverse sealing mechanism 240 in the up and down direction.

In the bagmaking and packaging apparatus 10, the first partition plates 250 are disposed between the former mechanisms 210 and the transverse sealing mechanisms 240. Thus, the transverse sealing mechanisms 240 are less likely to be dirtied by debris such as fragments of the product P dropped and supplied by the combination weighing apparatus 600. Furthermore, in the bagmaking and packaging apparatus 10, the first partition plates 250 disposed between the former mechanisms 210 and the transverse sealing mechanisms 240 are plate-shaped, so when fragments and such of the product dropped and supplied by the combination weighing apparatus 600 fall onto the first partition plates, it is easy to remove them.

For that reason, in this bagmaking and packaging apparatus 10, it is easy to keep the bagmaking and packaging apparatus 10 clean even when there is less space that can be utilized for maintenance due to the two bagmaking and packaging machines 100A, 100B being disposed in close proximity to each other in the left and right direction.

4-9

The weighing and packaging system 1 of the above embodiment includes the bagmaking and packaging apparatus 10 and the combination weighing apparatus 600. The combination weighing apparatus 600 includes the two combination weighing machines 610A, 610B that are joined to each other substantially symmetrically in the left and right direction and the base member 690 that integrally supports the combination weighing machines 610A, 610B. Each of the combination weighing machines 610A, 610B has the plurality of weigh hoppers 650 disposed along part of a circle as viewed in a top view and the discharge chute 670, weighs the product P supplied to the insides of the weigh hoppers 650, combines the product P being retained inside one or more of the weigh hoppers 650 selected in accordance with the target weight, and discharges the product P from the discharge chute 670.

In the weighing and packaging system 1, the width of the space required to install the weighing and packaging system 1 can be reduced.

4-10

The weighing and packaging system 1 of the above embodiment includes the elevated platform 700. The elevated platform 700 has the walk board 710 disposed around the base member 690 and the elevated platform frame 720 that supports the walk board 710.

In the weighing and packaging system 1, maintenance space can be ensured around the combination weighing apparatus 600.

(5) Example Modifications

Examples modifications of the above embodiment will be described below. It will be noted that some or all of the content of each example modification may be combined with the content of the above embodiment and/or the content of another example modification to the extent that they are not mutually contradictory.

(5-1) Example Modification A

In the above embodiment, the support posts 510 of the bagmaking and packaging machines 100A, 100B are arranged to be bilaterally asymmetrical, but they are not limited to this. For example, all the support posts 510 whose upper ends are disposed in positions higher than the transverse sealing mechanism 240 in the bagmaking and packaging machines 100A, 100B may be disposed rearward of the tubes 214 of the former mechanisms 210. In this case also, high cleanability is easily obtained. However, from the standpoint of support stability, it is preferred that the support posts 510 be configured as in the above embodiment.

(5-2) Example Modification B

In the above embodiment, the first partition plate 250, the second partition plate 260, and the gap-closing member 420 are configured by separate members, but they are not limited to this. For example, the first partition plate 250, the second partition plate 260, and the gap-closing member 420 may be configured from one plate member. In this case, debris can be prevented from depositing in seams between members.

REFERENCE SIGNS LIST

10: Bagmaking and Packaging Apparatus
100A: Bagmaking and Packaging Machine
100B: Bagmaking and Packaging Machine
210: Former Mechanism
212: Former
214: Tube
240: Transverse Sealing Mechanism
250: First Partition Plate (Partition Plate)
300: Film Supply Unit
420: Gap-closing member
450: Housing Unit
460: Control Unit
462: Circuit Board
500: Frame

510: Support Posts
510R: Right End (Right End of Support Posts Disposed Rightmost)
510L: Left End (Left End of Support Posts Disposed Leftmost)
600: Combination Weighing Apparatus
610A: Combination Weighing Machine
610B: Combination Weighing Machine
690: Base Member
700: Elevated Platform
710: Walk Board
720: Elevated Platform Frame
F: Film
Ft: Tubular Film (Film in Tubular Shape)
Op: Openings
P: Product
R: Conveyance Path (Conveyance Path of Film)
W1: Width of Base Member
W2: Maximum Width of Bagmaking and Packaging Apparatus
W3: Distance

What is claimed is:

1. A bagmaking and packaging apparatus comprising two bagmaking and packaging machines installed side-by-side in a left and right direction, wherein each of the bagmaking and packaging machines comprises:

a film supply unit that is disposed in a rear portion of the bagmaking and packaging machine;

a former mechanism that is disposed in a front portion of the bagmaking and packaging machine, has a former and a tube, and is configured to form in a tubular shape a sheet-form film supplied from the film supply unit in the rear portion of the bagmaking and packaging machine, a transverse sealing mechanism that is disposed below the former mechanism and is configured to transversely seal a top and a bottom of the film in the tubular shape into which a product supplied from above is fed, and a control unit that is configured to control the operations of the film supply unit and the transverse sealing mechanism, each of the bagmaking and packaging machines is disposed under a discharge chute of a corresponding one of the combination weighing machines of a combination weighing apparatus, the combination weighing apparatus includes two combination weighing machines joined to each other substantially symmetrically in the left and right direction as viewed in a top view and a base member that integrally supports the combination weighing machines, each of the combination weighing machines is configured to supply the product to insides of plural hoppers arranged along part of a circle and is configured to combine and discharge the product being retained inside one or more of the hoppers selected in accordance with a target weight, and a maximum width of the bagmaking and packaging apparatus when viewed from the front is narrower than a width of the base member.

2. The bagmaking and packaging apparatus of claim 1, wherein each of the bagmaking and packaging machines further includes a housing unit that houses a circuit board of the control unit, and the housing unit is disposed rearward of the former mechanism and the transverse sealing mechanism.

3. The bagmaking and packaging apparatus of claim 2, wherein the housing unit is disposed under a conveyance path of the film in the film supply unit.

4. The bagmaking and packaging apparatus of claim 2, wherein each of the bagmaking and packaging machines includes plural upright support posts that configure a frame that surrounds at least part of each of the film supply unit, the former mechanism, and the transverse sealing mechanism, and a distance between a right end of the support posts disposed rightmost and a left end of the support posts disposed leftmost in the bagmaking and packaging apparatus is smaller than the maximum width of the bagmaking and packaging apparatus.

5. The bagmaking and packaging apparatus of claim 1, wherein each of the bagmaking and packaging machines includes plural upright support posts that configure a frame that surrounds at least part of each of the film supply unit, the former mechanism, and the transverse sealing mechanism, in the bagmaking and packaging machine on a left side, the support post that is foremost on the left side is disposed rearward of the tube of the former mechanism, and in the bagmaking and packaging machine on a right side, the support post that is foremost on the right side is disposed rearward of the tube of the former mechanism.

6. The bagmaking and packaging apparatus of claim 1, wherein the two bagmaking and packaging machines have a substantially line-symmetrical structure in the left and right direction, and each of the bagmaking and packaging machines has an opening in at least part of its side surface that opposes the other bagmaking and packaging machine.

7. The bagmaking and packaging apparatus of claim 6, further including a gap-closing member that is provided between the two bagmaking and packaging machines and that closes off a gap between the two bagmaking and packaging machines.

8. The bagmaking and packaging apparatus of claim 1, wherein each of the bagmaking and packaging machines has a partition plate that is disposed between the former mechanism and the transverse sealing mechanism in an up and down direction.

9. A weighing and packaging system comprising:

the bagmaking and packaging apparatus of claim 1; and the combination weighing apparatus including the two combination weighing machines that are joined to each other substantially symmetrically in the left and right direction and the base member that integrally supports the combination weighing machines, each of the combination weighing machines having the plural hoppers disposed along part of a circle as viewed in a top view and the discharge chute, being configured to weigh the product supplied to the insides of the hoppers, combine the product being retained inside one or more of the hoppers selected in accordance with the target weight, and discharge the product from the discharge chute.

10. The weighing and packaging system of claim 9, further comprising an elevated platform that has a walk board disposed around the base member and an elevated platform frame that supports the walk board.

* * * * *